US005638417A

United States Patent [19]

Boyer et al.

[11] Patent Number: 5,638,417

[45] Date of Patent: Jun. 10, 1997

[54] SYSTEM FOR PILL AND CAPSULE COUNTING AND DISPENSING

[75] Inventors: Joseph H. Boyer; James P. Boyer, both of Johnson City; John Pellegrini, Vestal, all of N.Y.

[73] Assignee: Innovation Associates, Inc., Johnson City, N.Y.

[21] Appl. No.: 643,679

[22] Filed: May 6, 1996

[51] Int. Cl.[6] ..... G06M 7/00

[52] U.S. Cl. ..... 377/7; 377/6

[58] Field of Search ..... 377/6, 7, 11, 20

[56] References Cited

U.S. PATENT DOCUMENTS 5,473,703 12/1995 Smith ..... 377/11

*Primary Examiner*—Margaret Rose Wambach

*Attorney, Agent, or Firm*—Salzman & Levy

[57] ABSTRACT

There is provided a method for counting and dispensing pills, tablets, and capsules which depends on a simple vibrating, sloped, concave-shaped (e.g., V-shaped) trough, having a number of descending steps. The vibration of the trough is controlled and adjusted by a microprocessor. The vibration of the trough is patterned to provide a greater vibratory amplitude at its dispensing end than at its intake end. The difference at each end of the trough in vibratory amplitude is achieved by elastomeric supports that are differently spring dampened. The microprocessor electronically adjusts the input vibration to the trough, such that the flow of materials is adjusted for different types of materials (i.e., tablets of different shapes and/or sizes). This causes the tablets to align accurately within the trough, and sequentially pass a pill detector mechanism in single file. This ensures that the device can handle an extremely varied range of tablet or capsule sizes and shapes.

20 Claims, 21 Drawing Sheets

SYSTEM FOR PILL AND CAPSULE COUNTING AND DISPENSING

RELATED PATENT APPLICATION

This application is related to U.S. patent application, Ser. No. 08/643,676, filed concurrently herewith, for "Method for Counting and Dispensing Tablets, Capsules, and Pills."

FIELD OF THE INVENTION

The present invention pertains to pill and capsule counting and dispensing machines, and, more particularly, to an automated tablet counting and dispensing system that electronically controls the flow of materials in order to provide accurate counts irrespective of the size and shape of the tablets.

BACKGROUND OF THE INVENTION

The prior art is rife with vibratory dispersion and counting devices of one kind or another, for separating pills into a single file, and then counting the tablets as they drop off the vibrating table. Once separated into a one-at-a-time profile, the pills are counted, and then placed in a vial.

The general principle in all of these devices is to shake the materials as they travel along a sloping path, in order to effect their separation. Despite the simplicity of the separation concept, these devices cannot be applied for applications requiring small apparatus, low complexity, light weight, low cost and minimal operator supervision. Problems arise when the shape and size of the pills vary. This variation most commonly requires unique parts for each table or capsule to accommodate the different shapes and/or sizes of the tablets. The need for a customized device, with changeable parts and/or extensive adjustments, unfortunately, defeats the purpose of providing a machine to perform pill counts automatically.

The present invention reflects the realization that any pill counting and dispersing system or machine must be reliable and accurate. The counting and dispensing system of this invention uses an innovative variation of the prior art vibratory tablet separating mechanism, with an improved actuating control system to help automate the procedure. The inventive system, with a single, three-position, mechanically adjusted metering device, is able to accommodate the complete range of different pill sizes and shapes.

In order to achieve the separation of the tablets, which is often called singulation, the inventive system does not use separate V-plates vibrating at different rates or amplitudes as shown in the prior art. Nor does this invention use long plates, often used in the prior art in order to allow the pills enough time to separate as they travel forward. Rather, this invention uses a single, relatively short, lightweight, concave-shaped, stepped trough, that is vibrationally driven electromagnetically at just a single point.

Despite the single vibratory control, this system is able to vibrate more strongly (with a larger amplitude) at its lower, dispensing end, than at its upper end. The difference in amplitude of vibration in the two ends of the trough provides an improved vibratory action, which for the first time accomplishes accurate singulation of tablets and capsules in such a small device.

The difference in amplitude of vibration is achieved by supporting the plate at each end with an elastomeric spring/damper support, the support at the upper end having a higher spring constant than the support at the lower end. This difference causes the lower end of the plate to vibrate with greater amplitude. The use of a single concave-shaped trough, driven at a single point and supported at only two points, achieves the simplicity, low cost, and compact form of the device.

SUMMARY OF THE INVENTION

In accordance with the present invention, there is provided a pill and capsule counting and dispensing machine. The machine comprises a simple vibrating, sloped, concave-shaped trough, having a number of descending steps. The vibration of the trough is controlled and adjusted by a microprocessor. The vibration of the trough is patterned to provide a greater vibratory amplitude at its dispensing end than at its intake end. The difference at each end of the trough in vibratory amplitude is achieved by elastomeric supports that are differently spring dampened. The microprocessor electronically adjusts the input vibration to the trough, such that the flow of materials is adjusted for different types of materials (i.e., tablets of different shapes and/or sizes). This vibration adjustment, coupled with an adjustable metering device, causes the tablets to align accurately within the trough, and sequentially pass a pill detector assembly in single file. This ensures that the device can handle an extremely varied range of tablet or capsule sizes and shapes. The machine is compact and more cost effective than other similar apparatus. It is able to count accurately and quickly to improve throughput, as befits many different intended applications. Its compact structure allows its use in banks or arrays. The machine is compact enough to allow a single operator to handle 200 or more dispensers from a single workstation. The form of the device will also allow its use in automated dispensing or prepackaging facilities, which can then be economically configured. The form factor favors both front and back replenishment, expanding the number of economical applications to include, but not be limited to, unit dose packaging applications (hospitals, nursing homes), mail-order pharmacies, pharmaceutical vending machines, pharmacies, etc.

BRIEF DESCRIPTION OF THE DRAWINGS

A complete understanding of the present invention may be obtained by reference to the accompanying drawings, when considered in conjunction with the subsequent detailed description, in which:

FIGS. 3*a* through 3*l* illustrate flow diagrams of the control methodology for the apparatus shown in FIG. 2;

DESCRIPTION OF THE PREFERRED EMBODIMENT

Generally speaking, the invention features a tablet counting and dispensing system wherein tablets, pills, and capsules of all different shapes and sizes can be accurately counted and dispensed. The system comprises a vibrating, sloped, concave-shaped trough into which a plurality of tablets are introduced. A three-position metering device dispenses the tablets to the trough, which is stepped and set at a shallow angle to the horizontal (nominally 3 to 5 degrees). The trough is vibrated electromagnetically to cause the tablets to move downwardly. The tablets travel down the sloped trough, where they are vibrationally separated into a sequential profile. The tablets then travel in single file past a pill sensing mechanism, where they are accurately sensed by a suitable sensor and counted by a processor. The tablets are then housed within a dispensing chamber to await release to a vial or container.

Figure 1:
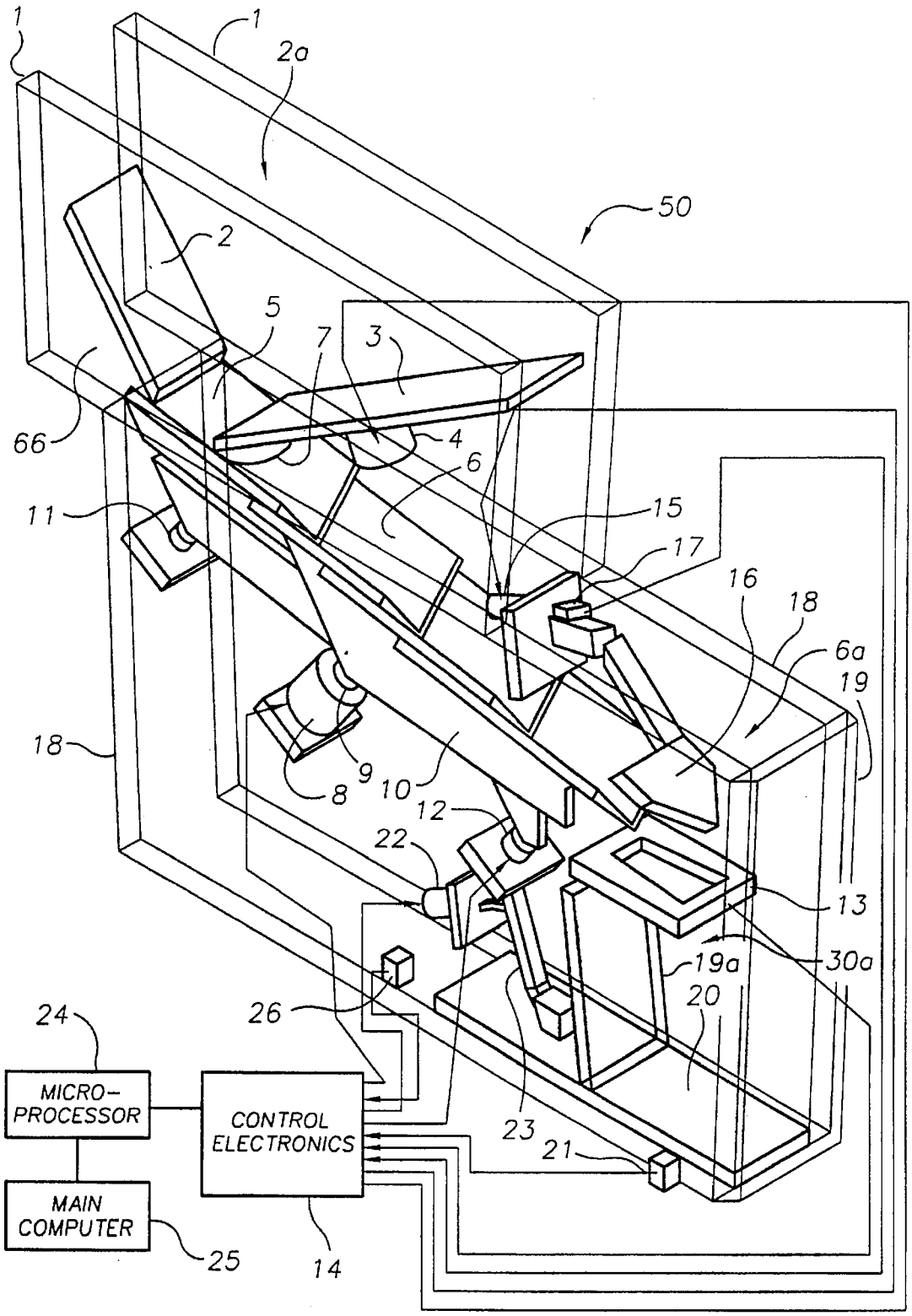
FIG. 1 depicts a perspective view of the apparatus of this invention as phantomly configured within its housing, and schematically wired to its control electronics.
Figure 1A:
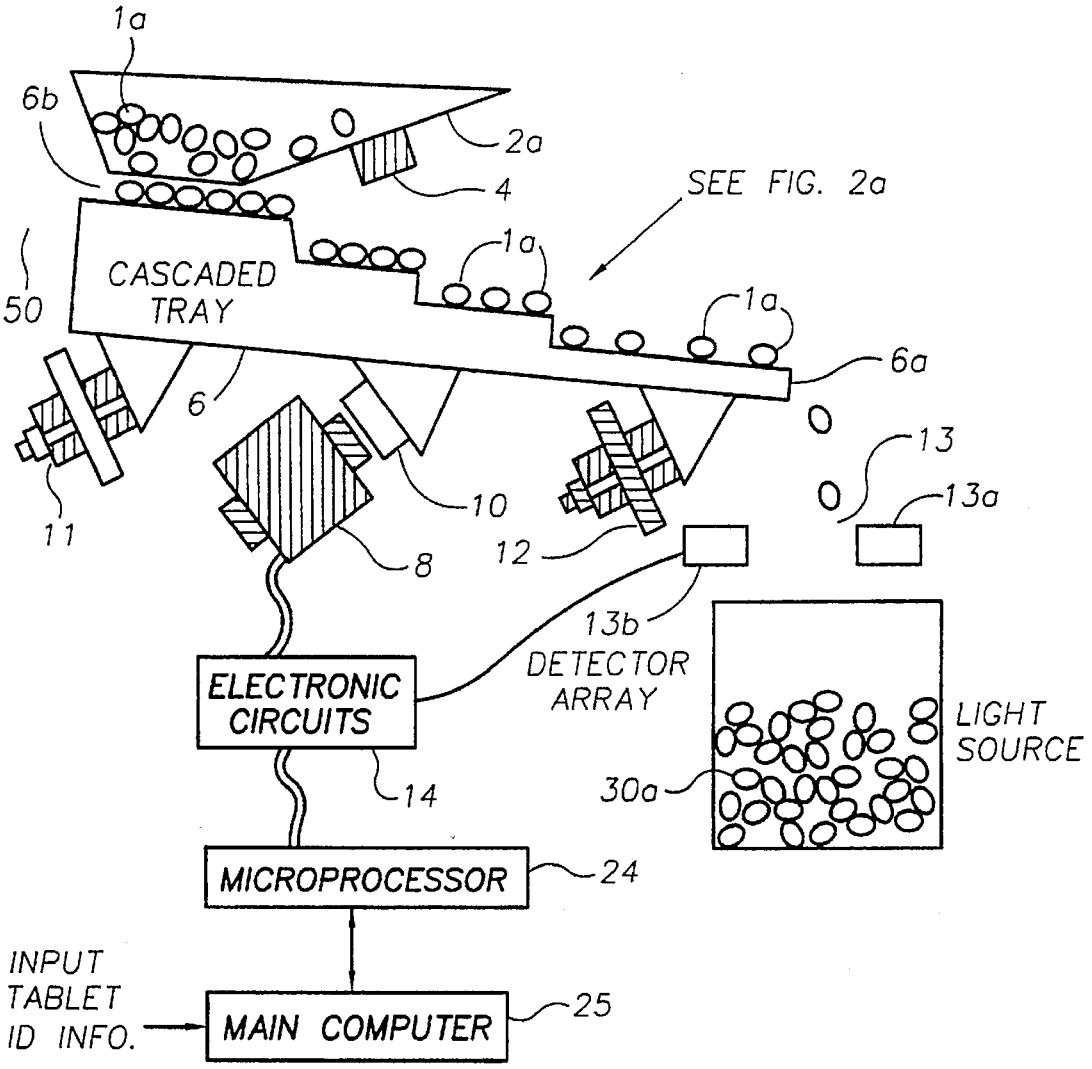
FIG. 1*a* illustrates a schematic view of the apparatus of this invention, with an in situ view of the flow of a plurality of tablets along a vibrating trough mechanism.

Now referring to FIG. 1*a*, a schematic side view of the tablet counting and dispensing system 50 of this invention is shown. The tablet counting and dispensing system 50 has a device or mechanism for holding and/or loading a quantity of tablets 1*a*. This device or mechanism may be disposed proximate the remaining elements of the apparatus of this invention, or may be displaced by a great distance, depending upon process control design parameters and requirements. In the preferred embodiment, a hopper 2*a* is proximate the remainder of the apparatus, as described hereinbelow.

Figure 2A:
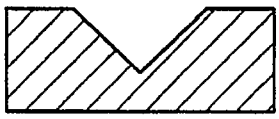
FIG. 2*a* illustrates a sectional view of the trough shown in FIG. 1*a;*

The tablets 1*a* are tossed into the hopper 2*a* in random fashion, where they are vibrated as needed, by vibrator 4, in order to cause them to flow out of the hopper 2*a* and onto a stepped, cascading trough 6. The cascading trough 6 is concave-shaped (such as U-shaped, V-shaped, or any suitable concave-like cross section), as is illustrated in FIG. 2*a*. It should be understood that the concave cross section can vary one or more times throughout its length (e.g., from a U-shape at its upper end to a V-shape at its lower end). The tablets 1*a* travel down the center of the channel of the stepped, cascading trough 6, under the vibratory influence of an electromagnet 8. In so traveling along the stepped, cascading trough 6, the tablets 1*a* separate and form into a single file. It has been found that a roughened upper surface of platform 6 results in improved tablet separation. Such roughening can be accomplished by any method well-known in the art, such as sand-blasting, abrading, etc.

The tablets 1*a* then drop off the lower end 6*a* of the trough 6, one at a time. The tablets 1*a* then pass a pill detector assembly 13 (having an infrared light-emitting diode 13*a* and corresponding photo detector array 13*b*), where the tablets 1*a* are sensed, and then dropped into a buffer area 30*a*.

The trough 6 vibrates with a greater amplitude at its lower, dispensing end 6*a*, than at its upper end 6*b*. The higher vibratory amplitude at the lower end 6*a* is a result of the lower spring constant of the lower spring dampener support 12, with respect to the spring constant of the upper spring dampener support 11. The greater amplitude of the vibration at the lower end causes the tablets 1*a* to separate more rapidly as they approach lower end 6*a*, as illustrated.

A main computer 25 is operatively connected to one or more microprocessors 24. Each microprocessor 24 is devoted to a single electromechanical dispenser via associated electronic circuits 14, which, among other functions, vary the voltage of the pulses sent to the electromagnet 8. This will vary the amplitude of the vibratory force that is induced in the stepped trough 6. The processor 24 can be programmed to change the voltage depending on the particular shape and/or size of the tablets 1*a*.

Referring to FIG. 1, the tablets 1*a* (not shown in this FIGURE) are placed in the hopper 2*a* formed of two adjacent side plates 1, and sloping plates 2 and 3. Sloping plate 3 is vibrated by hopper vibrator 4, as aforementioned. Tablets 1*a* flow downwardly through opening 5 between the lower ends of plates 2 and 3, and drop onto stepped, concave-shaped trough 6, and begin to flow down the trough 6. The height of a pile of tablets 1*a* entering the trough 6 is limited by a metering device, described hereinbelow, so that the tablets 1*a* will flow smoothly along the trough 6. The height of the tablets 1*a* is limited by a manually adjustable metering device 7 that is disposed beneath plate 3 adjacent opening 5.

The trough 6 is vibrated by an electromagnet 8. The electromagnet 8 acts upon a permanent magnet 9 that is attached to a support member 10, which carries the trough 6. The permanent magnet 9 ensures that there will be a switching between attractive and repulsive forces for each half cycle of alternating current. As electromagnet 8 is driven by the alternating current, an attractive force is applied to support member 10 and trough 6 during one half of the alternating current cycle, and a repulsive force is applied during the other half of the cycle. This alternating force applies a more effective vibration to the trough 6. However, electromagnet 8 may be driven by any waveshape of alternating current (not limited to sinusoidal waveshapes), including rectangular, square, sawtooth waves, etc. These waves reverse the direction of the magnetic field of electromagnet 8 at intervals, not necessarily periodic intervals, or those evenly spaced in time to achieve additional desired motion of trough 6.

Support member 10 and trough 6 are supported on their upper end 6*b* by elastomeric spring/dampener support 11 and on their lower end 6*a* by elastomeric spring/dampener support 12. The spring constant of support 11 is greater than the spring constant of support 12. This causes the lower end 6*a* of trough 6 closest to support 12 to vibrate with a greater amplitude than does the upper end 6*b* of trough 6 closest to support 11. This action causes the tablets 1*a* flowing down the steps of the trough 6 to move more rapidly as they approach its lower end 6*a*. As a result of this facilitated movement, the tablets 1*a* become separated and spread out from each other, as illustrated in FIG. 1*a*. Through this action, the tablets fall off the lower end 6*a* of trough 6 one at a time.

Tablets or capsules 1*a* (not shown in this view) then fall through pill detector assembly 13 and the count is registered in microprocessor 24, via a detection algorithm which analyzes the waveforms originating in pill detector assembly 13. Upon initiation of counting, signals from microprocessor 24 are sent through control electronics 14 to solenoid assembly 15. This causes the safety gate 16 to open and allow tablets 1*a* to fall off the end 6*a* of trough 6. After the counting is completed, this drive signal is discontinued, and the safety gate 16 closes, preventing further movement of tablets not intended to be dispensed. A switch 17 included in solenoid assembly 15 registers the opening and closing of the safety gate 16, and communicates its position to microprocessor 24.

As the tablets 1*a* (not shown) fall through pill detector assembly 13, they accumulate in a buffer area 30*a* defined by side plates 18, end plate 19, back plate 19*a*, and release door 20, that holds the counted tablets. Microprocessor 24 receives a signal from switch 21 activated by the presence of a vial (not shown) next to the buffer area 30*a*. The vial is placed next to the buffer area 30 for receiving the tablets that have accumulated in the buffer area 30*a*. Microprocessor 24 then energizes solenoid assembly 22, causing linkage 23 to actuate the opening of door 20, thus releasing the tablets 1*a* to the vial. Switch 26 then senses the opening of door 20, and sends a signal to microprocessor 24. Alternatively, the tablets 1*a* may be conveyed through a tube or duct, not shown, to a container at a more remote location, as would typically be the case in a fully automated filling line or Rx unit dose packaging. In such a case, the function of switch 21 would be fulfilled through other means, such as a remote switch under computer control.

The control electronics 14 is regulated by the microprocessor 24, which is in turn managed by a main computer 25. It is feasible to arrange for a bank of devices 50 that are each controlled by the main computer 25. Each tablet/capsule counting and dispensing device 50 will be equipped with individual control electronics 14 and its own microprocessor 24. The microprocessor 24 may be packaged within the control electronics 14.

The sequence of actions carried out by microprocessor 24 is as described in the flow chart shown in FIG. 3*a* through 3*l*, described below.

The inventive system 50 is designed to handle any size or shape of tablet or capsule. Different tablets or capsules have different flow characteristics through the device. In order to accommodate these different characteristics, computer 25, microprocessor 24, and control electronics 14 are together able to cause electromagnet 8 to vibrate trough 6 at different amplitudes. They can also turn electromagnet 8 on and off at various times, when necessary, to facilitate tablet flow or to break jams of tablets or capsules. A jam sensing photoelectric cell (not shown) can be mounted above the trough 6. The jam sensing photoelectric cell will report any jam situations to the microprocessor 24 or may be used to control feeding from a large hopper. In addition, computer 25, microprocessor 24, and control electronics 14 are able to turn the hopper vibrator 4 on and off in various patterns in order to break jams of tablets or capsules in the hopper 2*a* formed by respective plates 1, 2, and 3. A photoelectric sensor (not shown) can also be mounted above the hopper 2*a* for sensing and reporting any jam situation.

Microprocessor 24 is sent information by computer 25 during power-on initialization. This information contains several items necessary to the operation of the device 50. The information which is sent includes:

a) the correct amplitude of voltage with which to excite electromagnet 8 for the type of tablet or capsule being dispensed by the device;

b) the correct amplitude of voltage with which to excite hopper vibrator 4 for the type of tablet or capsule being dispensed by the device;

c) further control characteristics for the type of tablet or capsule being dispensed by the device, including the increment of voltage that should be applied in the event that the counting rate slows down; the control information may also contain a signal to decrease the voltage should the counting rate increase to an unreliable level;

d) patterns of excitation for electromagnet 8 suitable for breaking jams in the trough 6 consistent with the type of tablet or capsule being dispensed by the device;

e) patterns of excitation for hopper vibrator 4 suitable for breaking hopper jams or controlled feeding consistent with the type of tablet or capsule being dispensed by the device;

f) detection characteristics for the type of tablet or capsule being dispensed (these may include, for example, the length and number of detector pulses required to recognize that capsules are stuck together, that a broken tablet fragment has passed through the detector, or that the tablets are separate and whole, but too closely spaced);

g) the anticipated rate of dispensing for the tablet or capsule;

h) the maximum number of tablets or capsules of a particular type that the dispenser may accept during an order to dispense; the number may be limited, based upon the fact that the hopper can only hold a given number of a particular capsule or tablet, or that this number is more than a standard vial can hold;

i) a special drive voltage for electromagnet 8 for use when dispensing the last few tablets in a requested count, and a special duty cycle for intermittently applying that drive voltage, in order to dispense those last few tablets more slowly and thereby achieve perfect accuracy in counting; and j) a pattern of excitation for release door 20, in order to use release door 20 as a device to shake loose any capsules or tablets which may have adhered to the plates or walls above release door 20 of the buffer area 30*a*.

Microprocessor 24 is programmed to send all of this information back to computer 25 in order to verify that all of the information sent was received correctly.

Figure 2:
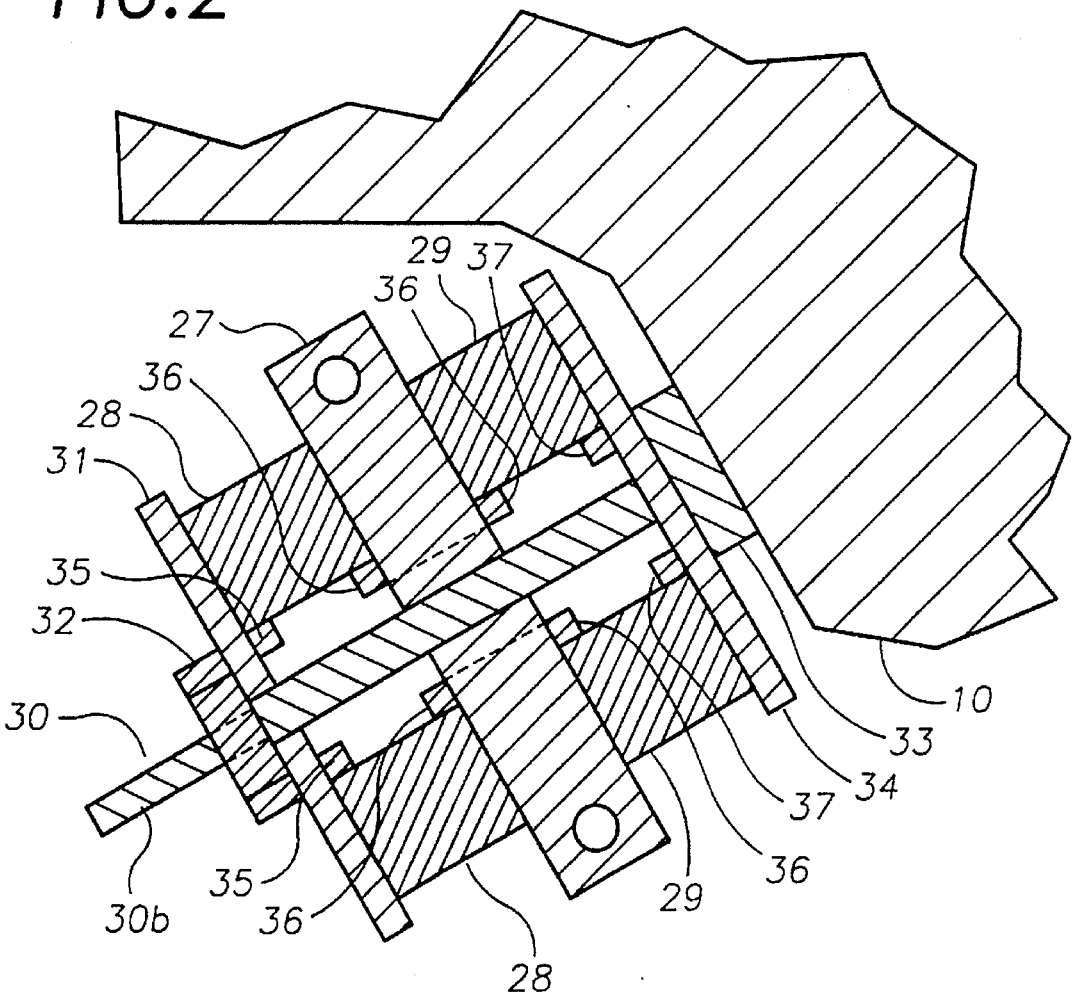
FIG. 2 shows a detailed side view of a spring dampener support for the trough illustrated in FIG. 2.

Referring to FIG. 2, an elastomeric spring/dampener mechanism is shown for supports 11 and 12. A support plate 27 is attached rigidly to the side plates 18 (not shown here) of the dispenser 50. Above and below support plate 27 are ring-shaped elastomeric spring/dampeners 28 and 29, which are both in contact with support plate 27.

Passing through the holes in ring-shaped elastomeric spring/dampeners 28 and 29, and through a hole in the center of support plate 27, is a rod 30. A washer 31, containing a central hole, is placed over rod 30 and presses against the bottom of the spring/dampener 28. Rod 30 has a narrow portion 30*b* at its lower end. A retainer 32 is placed over this narrow portion of rod 30, and is tightened up against the shoulder of the larger diameter part of rod 30. Retainer 32 presses against washer 31; this action brings washer 31 up to a position even with the shoulder of the larger diameter part of rod 30, and causes washer 31 to press against the bottom of spring/dampener 28 by an exact distance.

The other end of rod 30 is rigidly attached to projection 33 from the support member 10. A washer 34, rigidly attached to projection 33, is positioned over the other end of rod 30, pressing against the top of spring/dampener 29. Through the action of retainer 32 and the shoulder of rod 30, respective washers 31 and 34 compress respective spring/dampeners 28 and 29 against support plate 27 by an exact distance. Therefore, an exact amount of compression is exerted. Spring/dampeners 28 and 29 are thus preloaded with compressive force in such a way that they exert a controlled constraining force against the trough 6 in both directions of vibration.

Elastomeric rings 28 and 29 are properly centered within the assembly by annular boss or raised ring 35 disposed upon washer 31, two annular bosses 36 disposed upon support 27, and annular boss 37 disposed upon washer 34.

Rod 30 and the entire assembly of FIG. 2 are angled at 60 degrees to the horizontal. This is the same angle that electromagnet 8 and permanent magnet 9 make with trough 6. In this way, the direction of the vibration forces will be in alignment with rod 30.

Referring again to FIG. 1, the forward elastomeric spring/dampener support 12 and rear elastomeric spring/dampener support 11 are identical as described in FIG. 2, with the exception that the spring constant of the elastomeric rings in rear support 11 is greater than the spring constant of those in forward support 12.

Figure 3A:
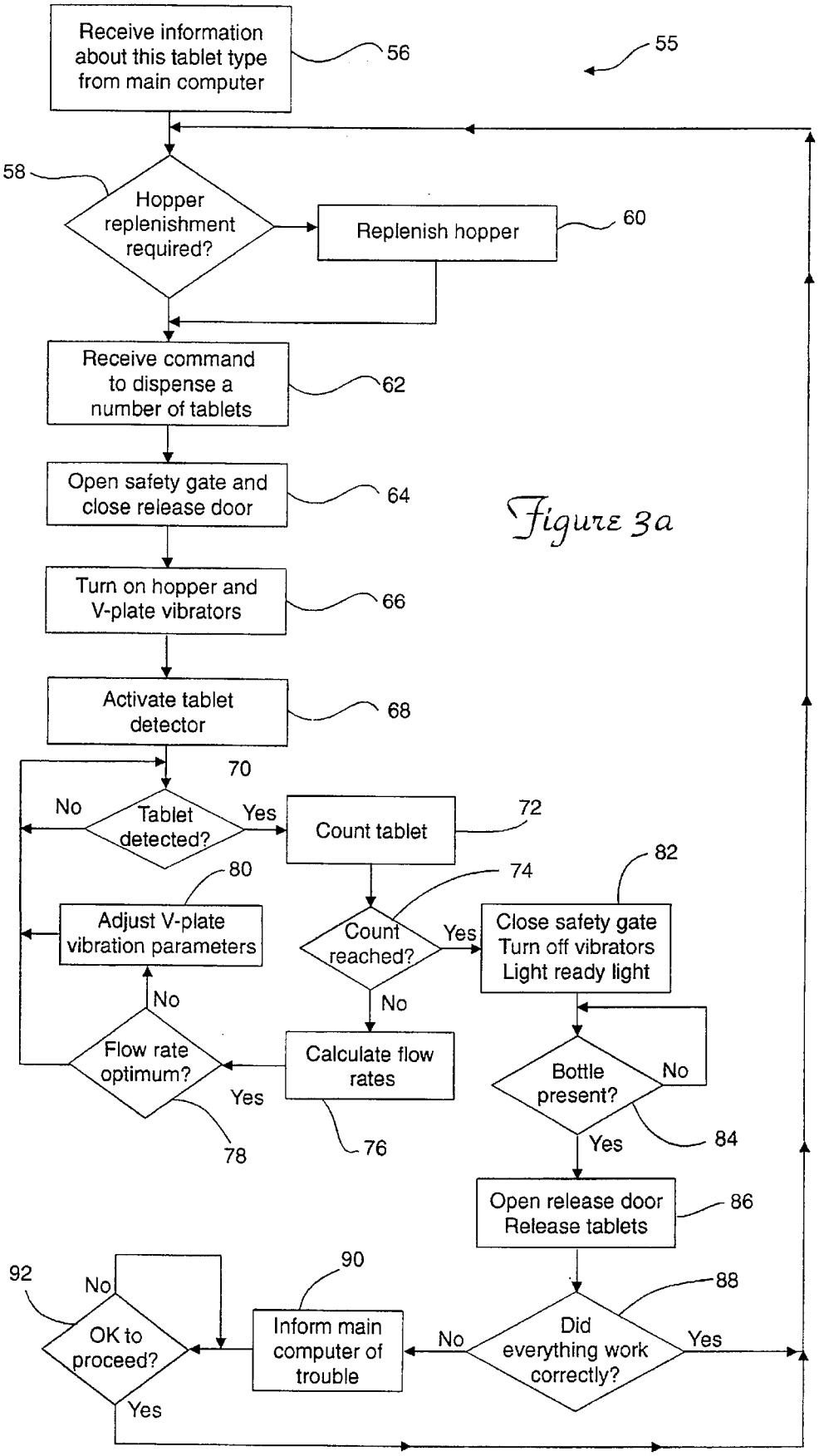
Figure 3B:
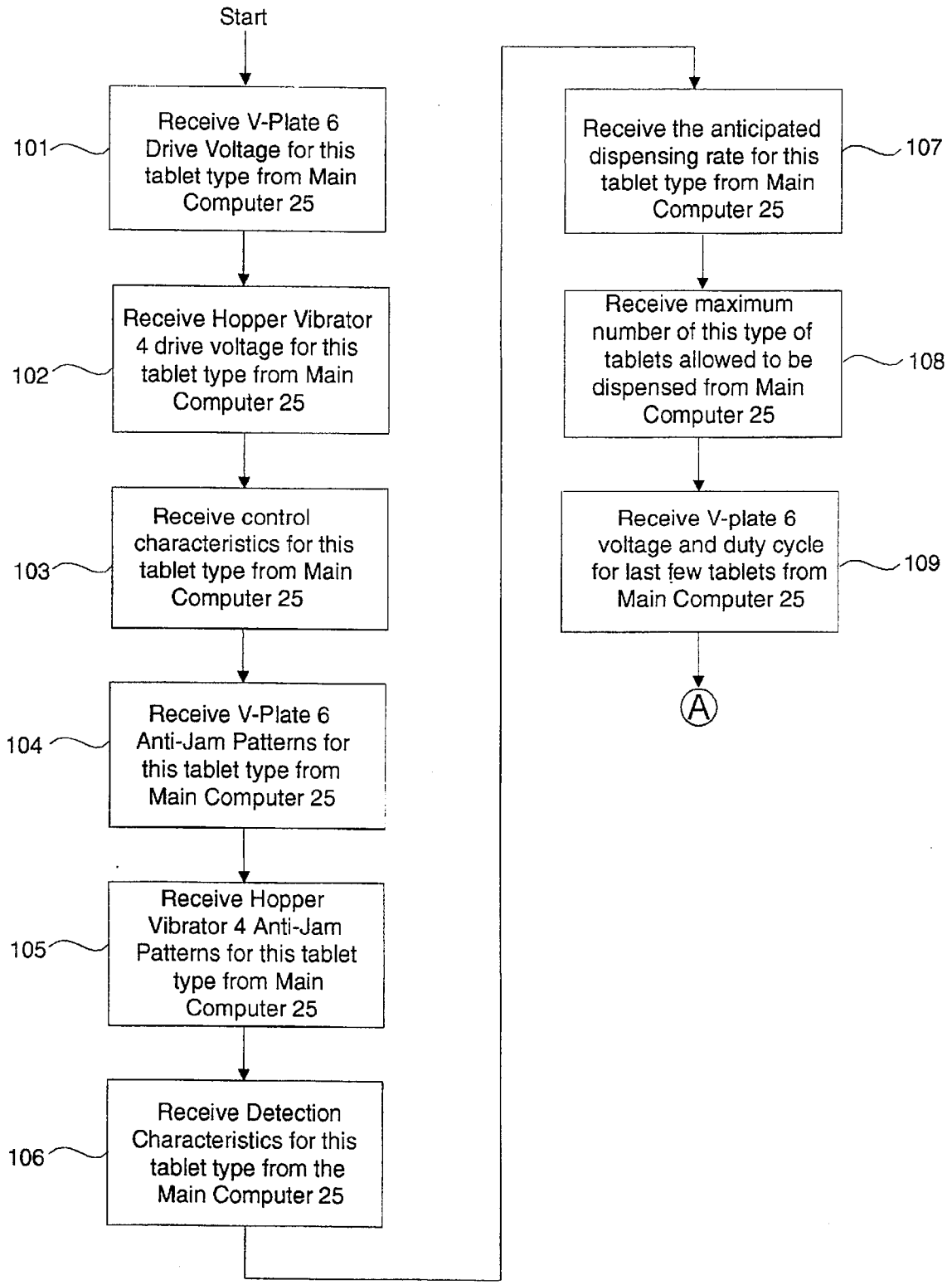
Figure 3C:
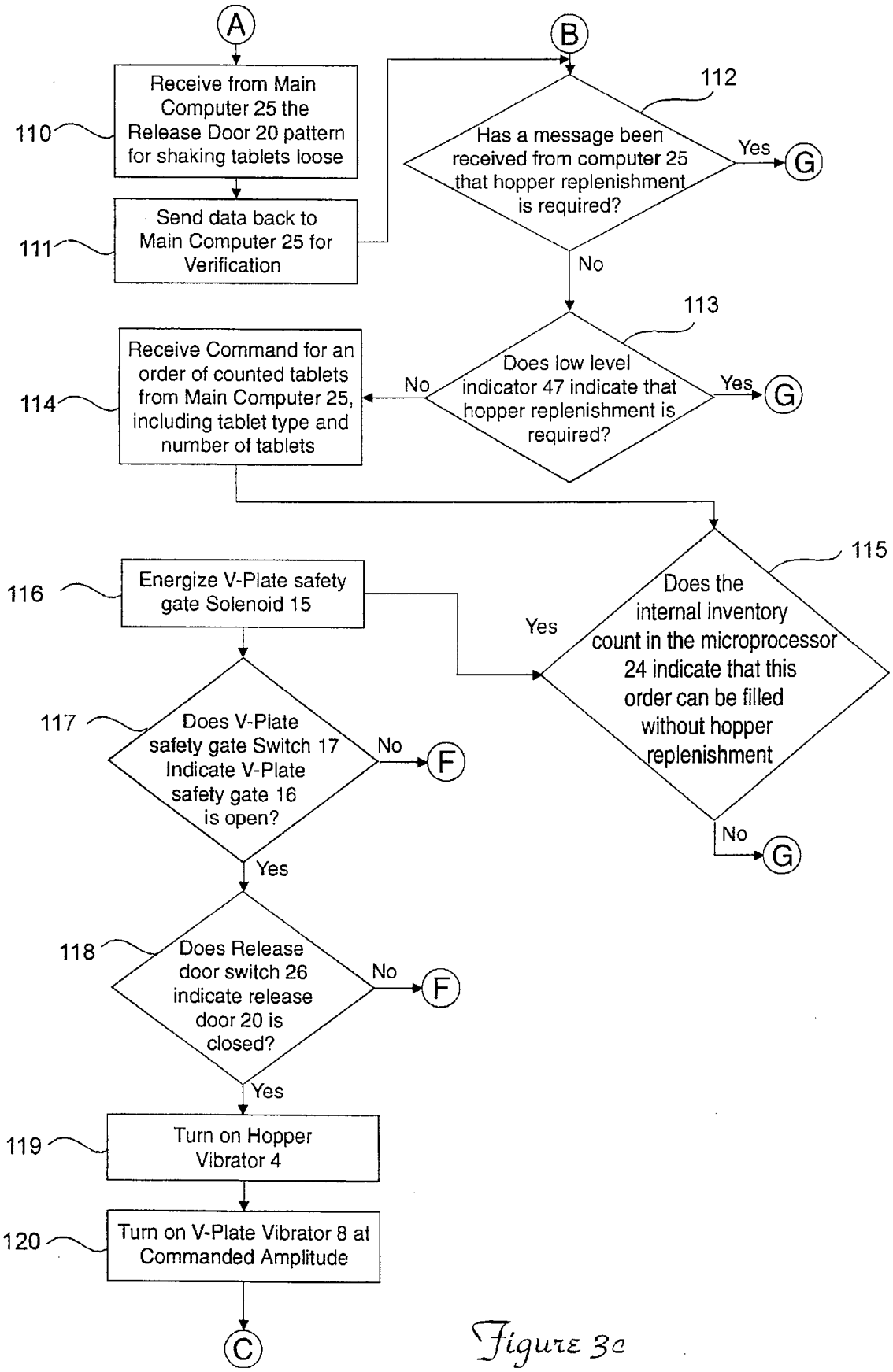
Figure 3D:
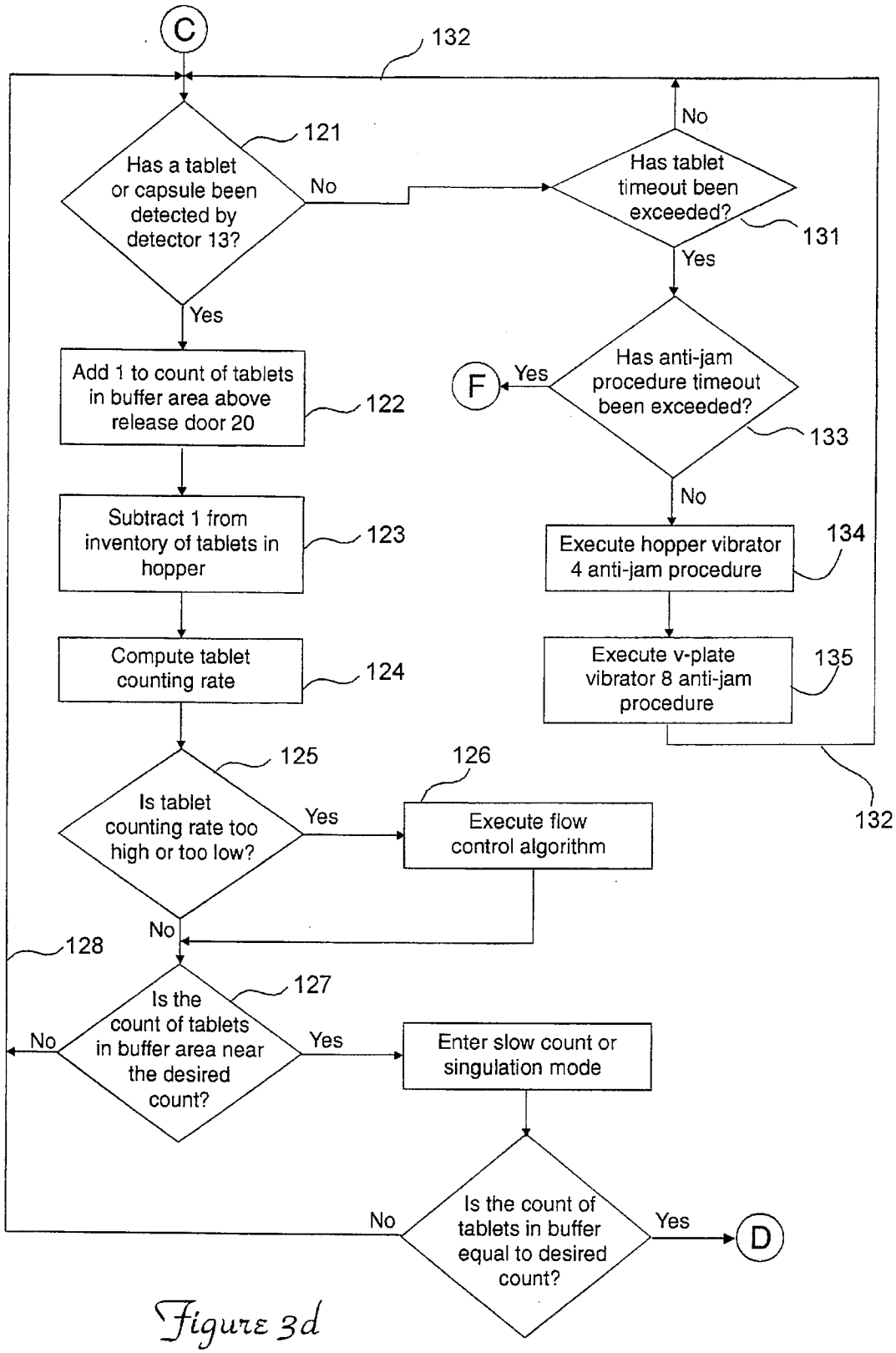
Figure 3E:
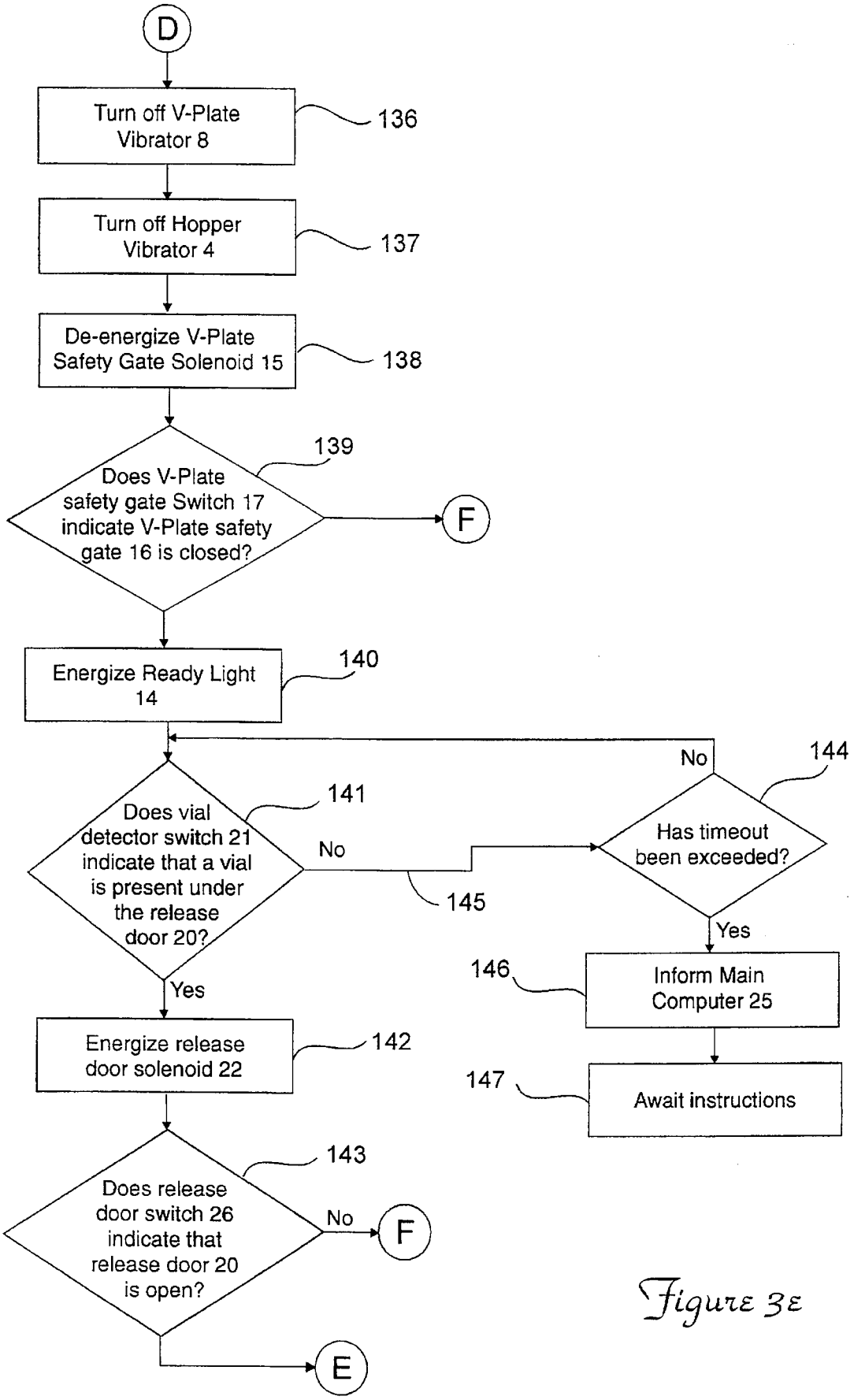
Figure 3F:
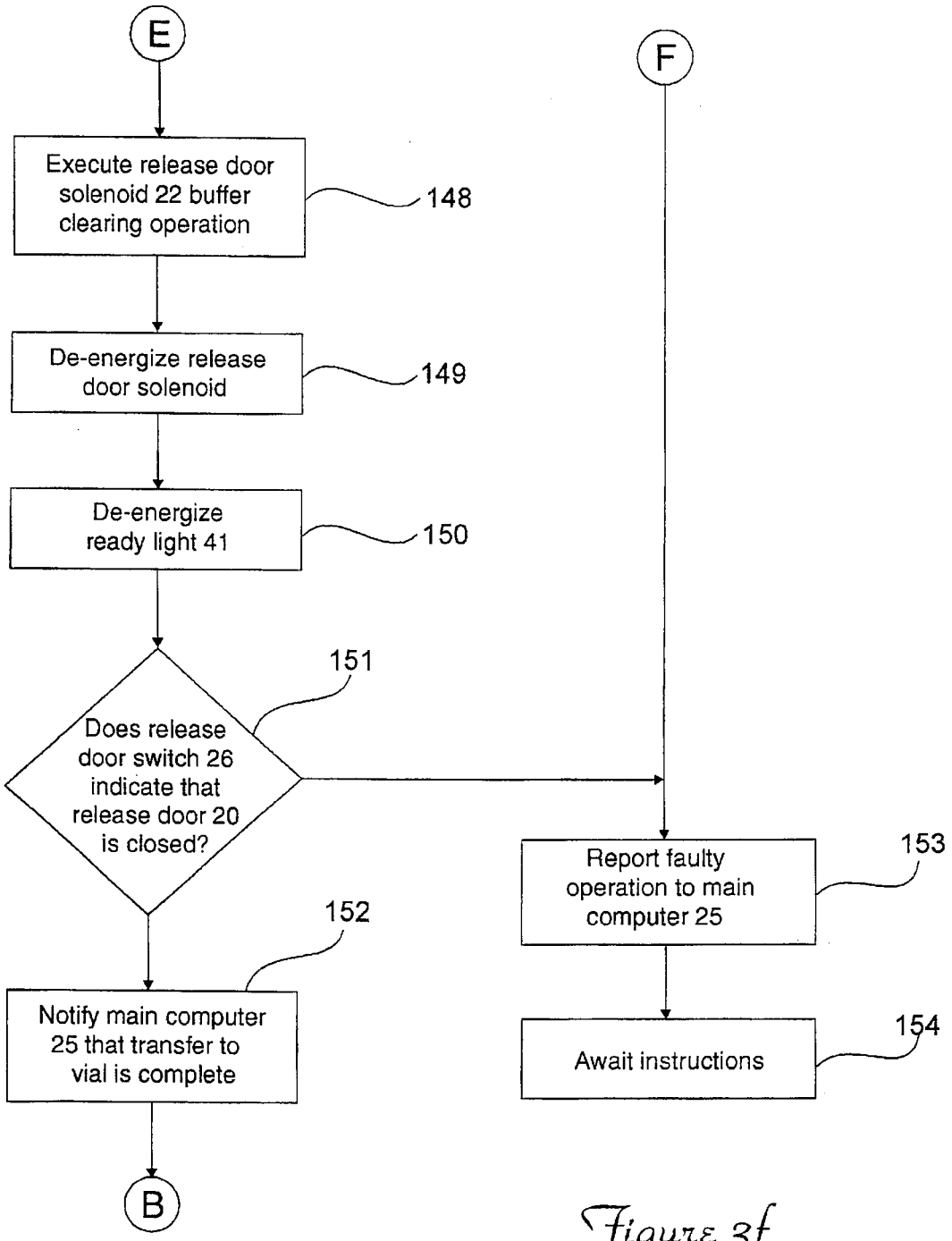
Figure 39:
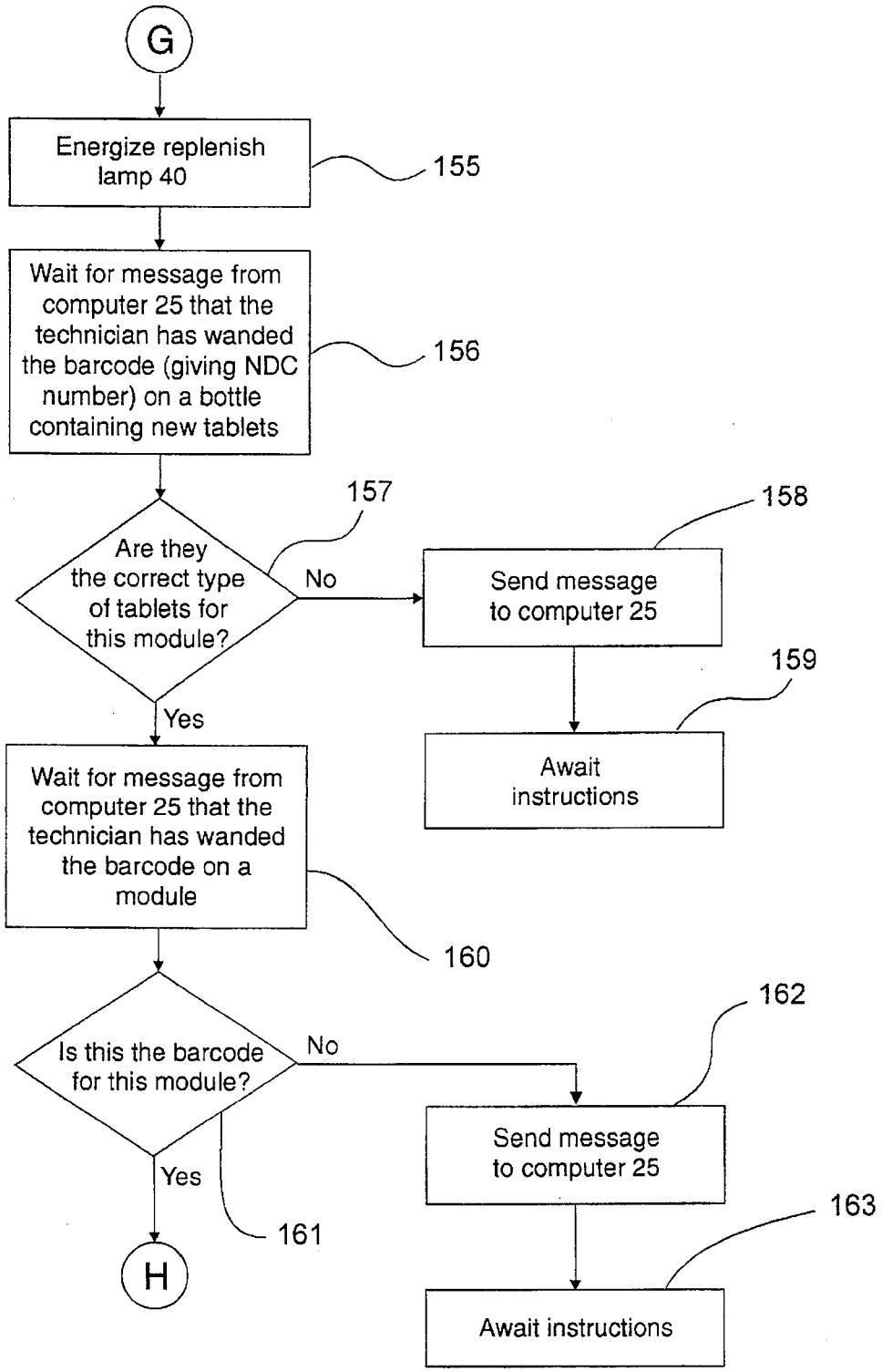
Figure 3H:
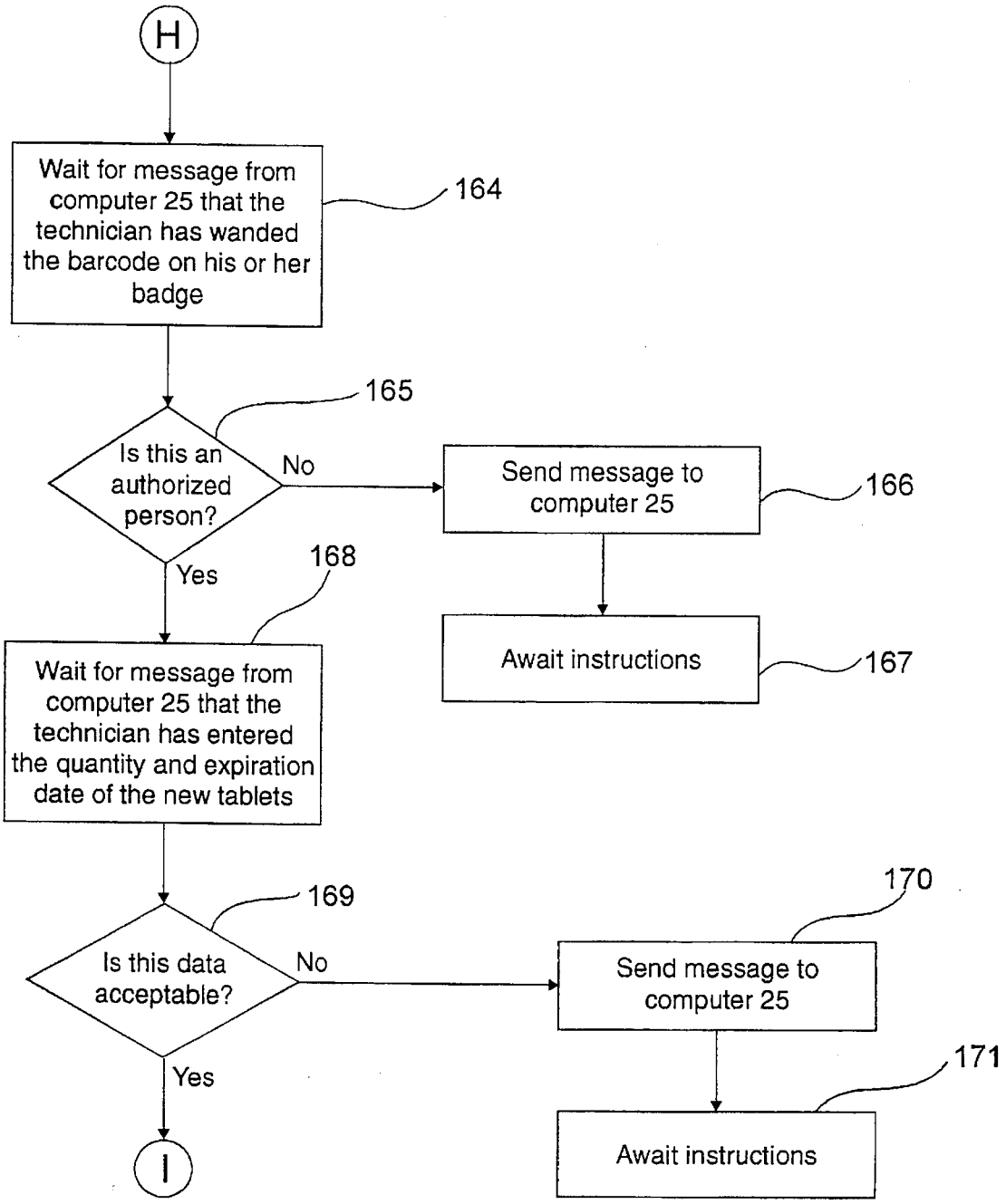
Figure 3I:
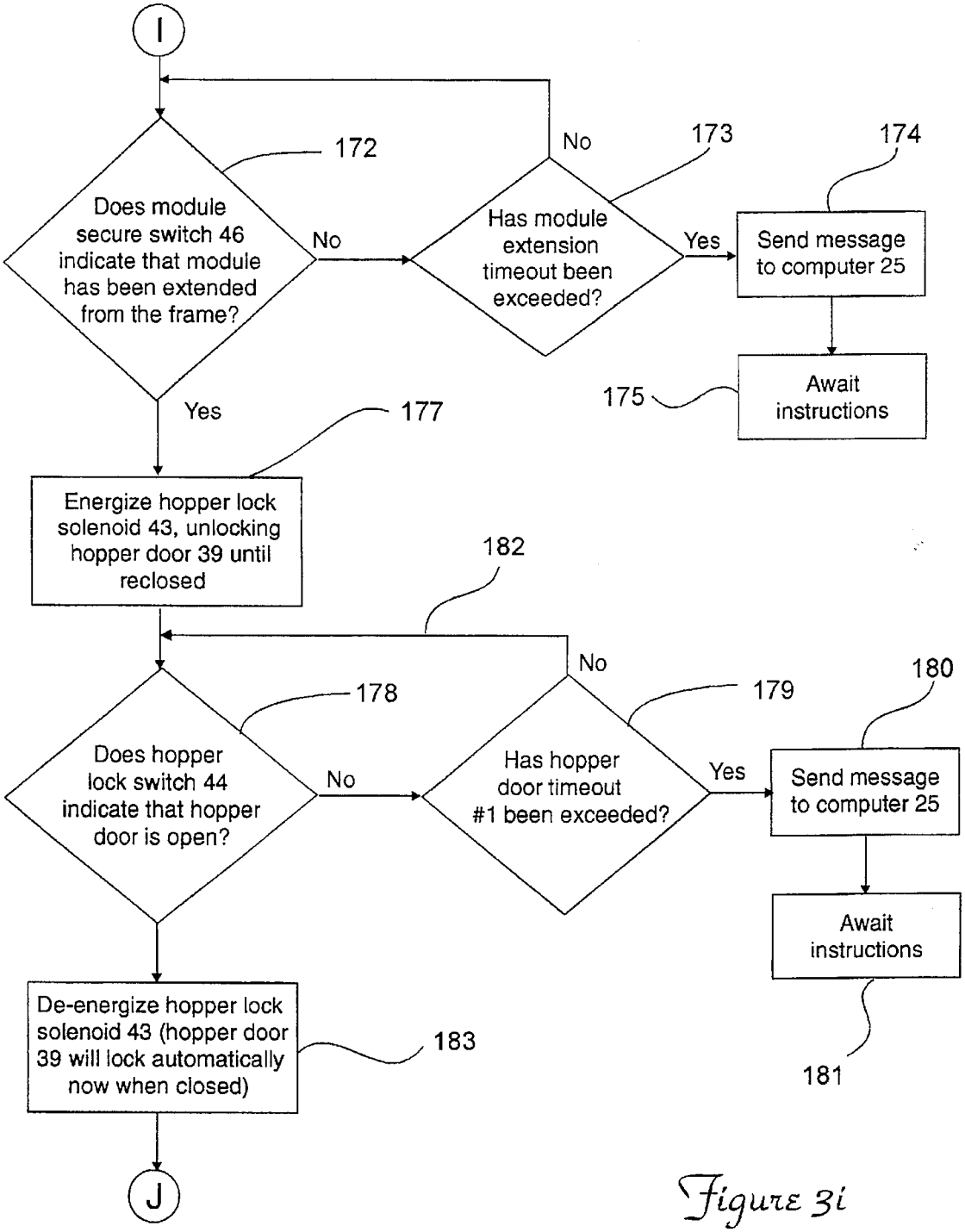
Figure 3J:
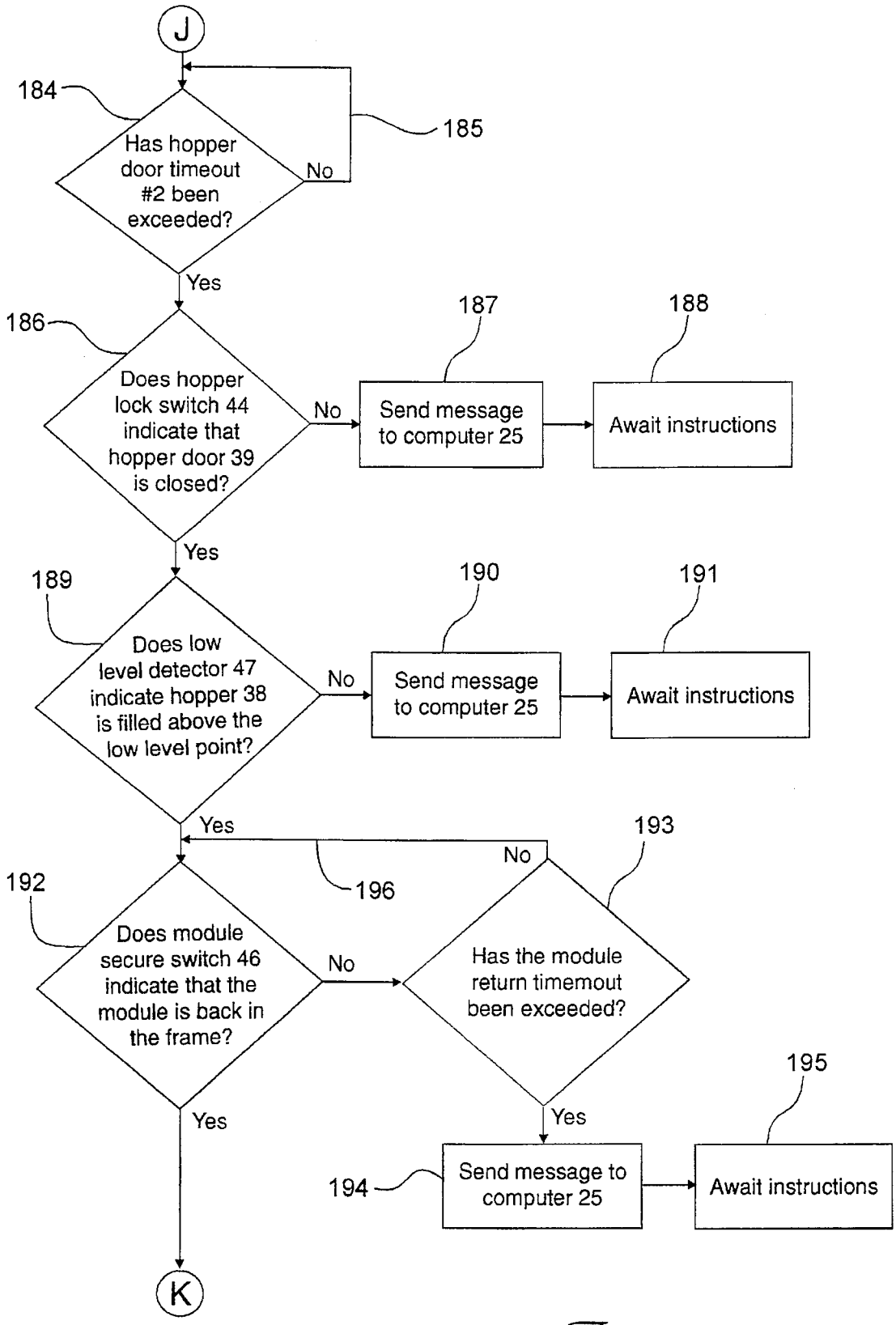
Figure 3K:
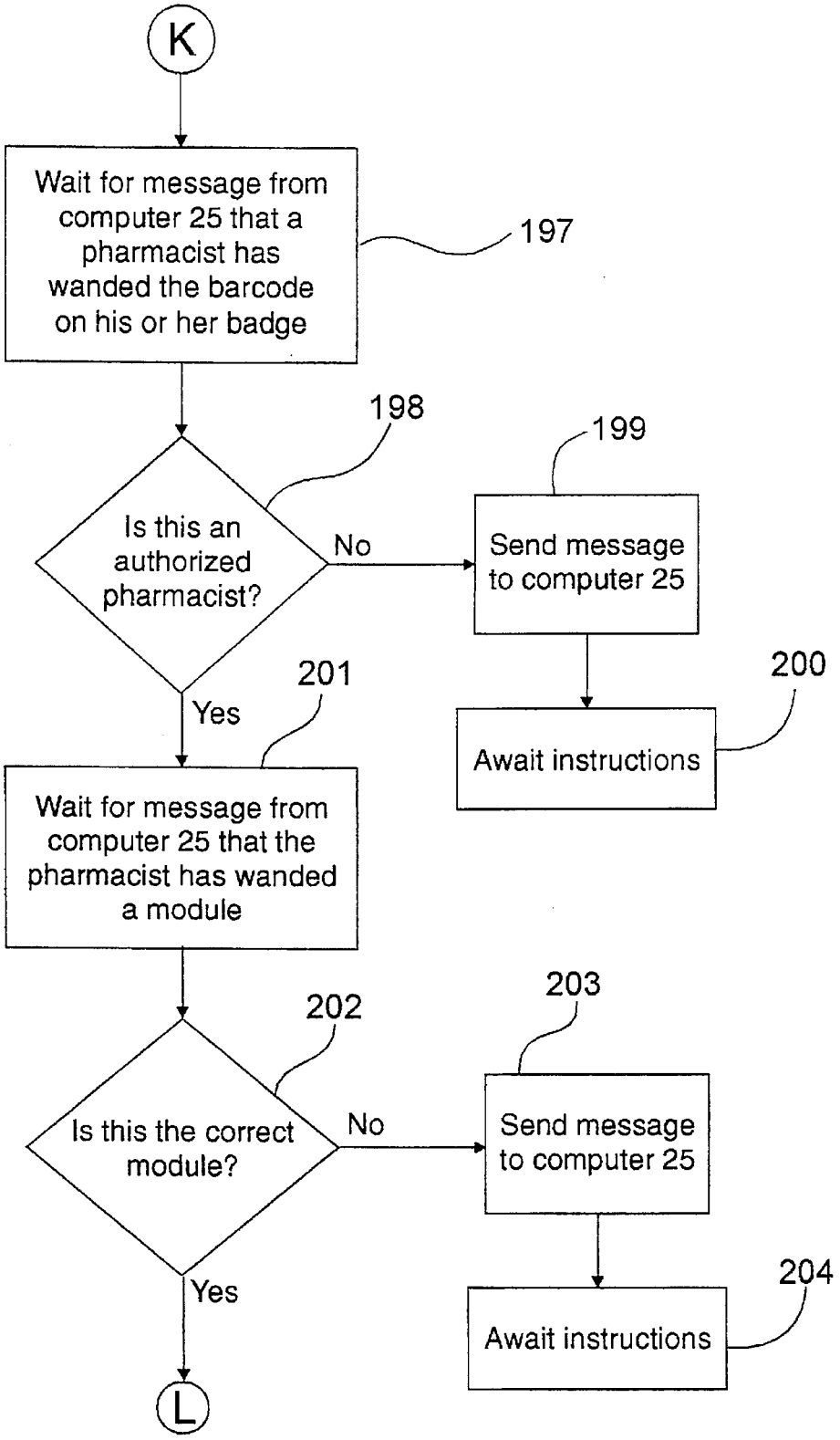
Figure 3L:
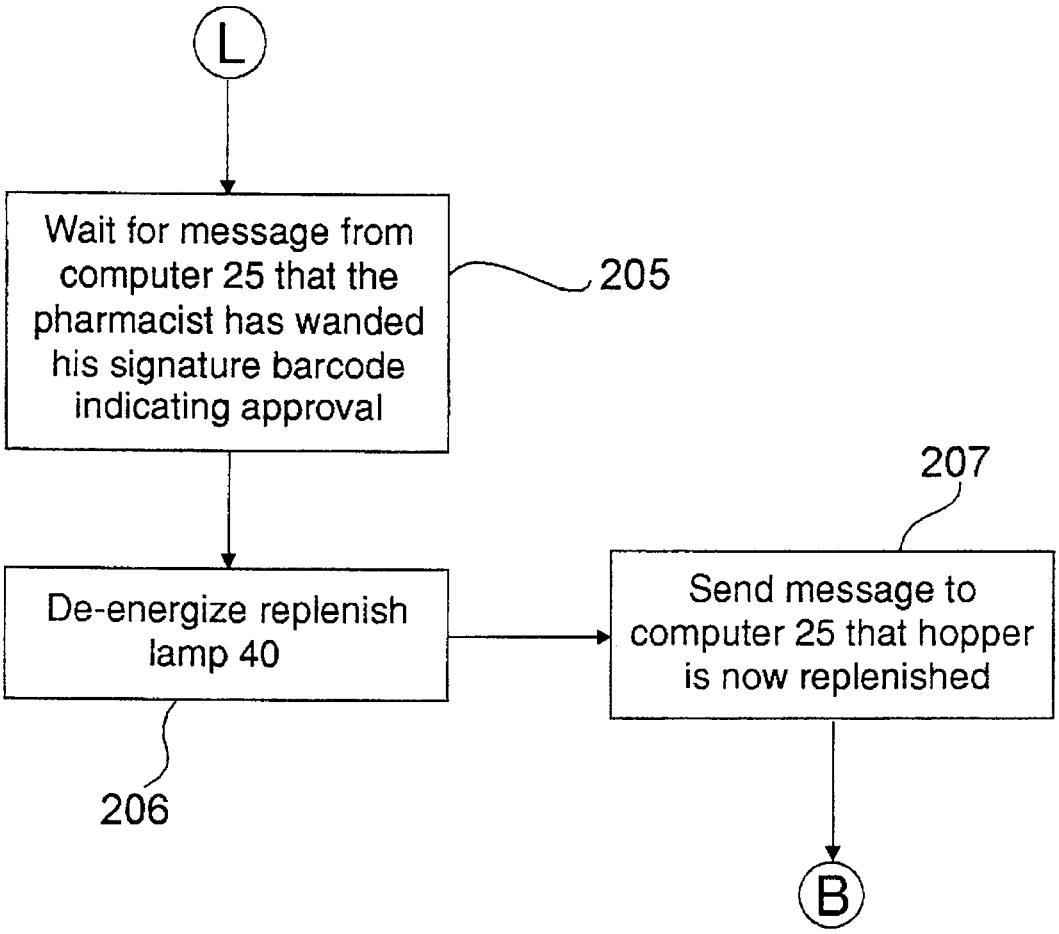
Figure 4:
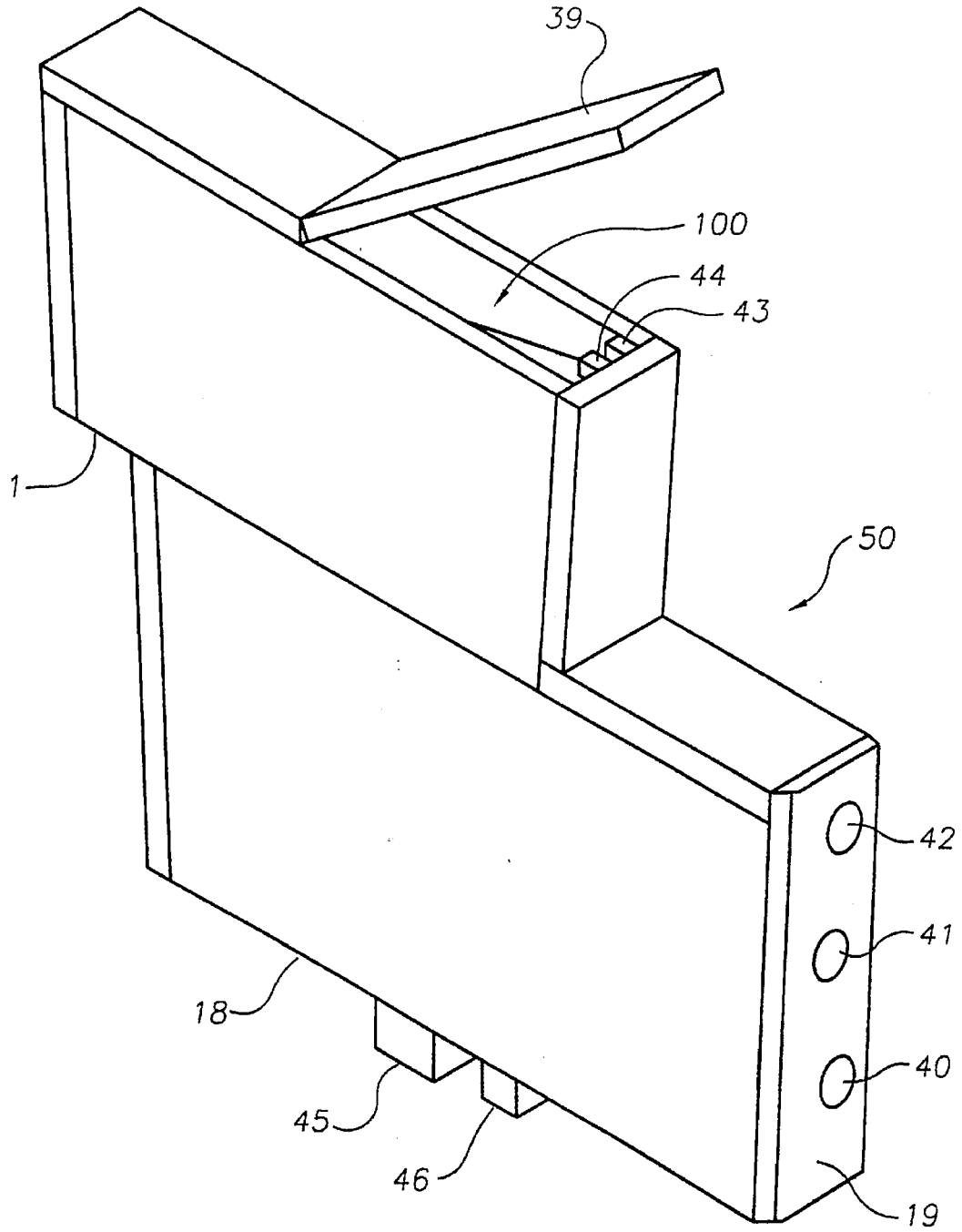
FIG. 4 depicts a perspective view of the housing for the apparatus illustrated in FIG. 2.

Referring to FIG. 4, the hopper 1*a*, formed by side plates 1 and bottom plates 2 and 3, is covered externally by a hopper door 39. Hopper door 39 may be placed at the front of the module as shown in FIG. 4, or may be placed at the rear of the module, if replenishment is to occur from the rear. Depending on user preferences, federal/state pharmacy legislated requirements, safety regulations or cost targets, a secure module solenoid 45 may be mounted beneath the device, which locks the module into place in a frame. When not locked into place, the module can be extended enough so that hopper door 39 can be opened. When the module is not locked into the frame, module assembly secured switch 46 reports that fact to microprocessor 24. Hopper door 39 is locked in place by a solenoid-operated hopper door lock 43. When hopper door 39 is open, that fact is reported to microprocessor 24 by hopper door open switch 44. When replenishment of the hopper is needed, that fact is conveyed to an operator or technician by replenish lamp 40, which may be placed on the rear of the module, when replenishment is to occur from the rear. Microprocessor 24 controls the replenishment process as described in the flowcharts illustrated in FIGS. 3*a* through 3*l*, and primarily in FIGS. 3*g* through 3*l*. However, this is a typical replenishment process, with more and less complex procedures being possible given different cost targets and safety regulations. The typical process given includes an inspection procedure by a pharmacist following the actual replenishment, in order to verify that the correct tablets have been placed in the hopper. Wiring to microprocessor 24 and control electronics 14 from the frame is long enough to provide power and communications to the module in its extended position.

On the front face 19 of the device, a ready light 41 informs the operator that a vial is ready for placement beneath the device 50 in order to receive an order of counted tablets.

Also on the front face 19, a status lamp 42 flashing at different rates informs a technician of certain operational states of the device 50.

Figure 5:
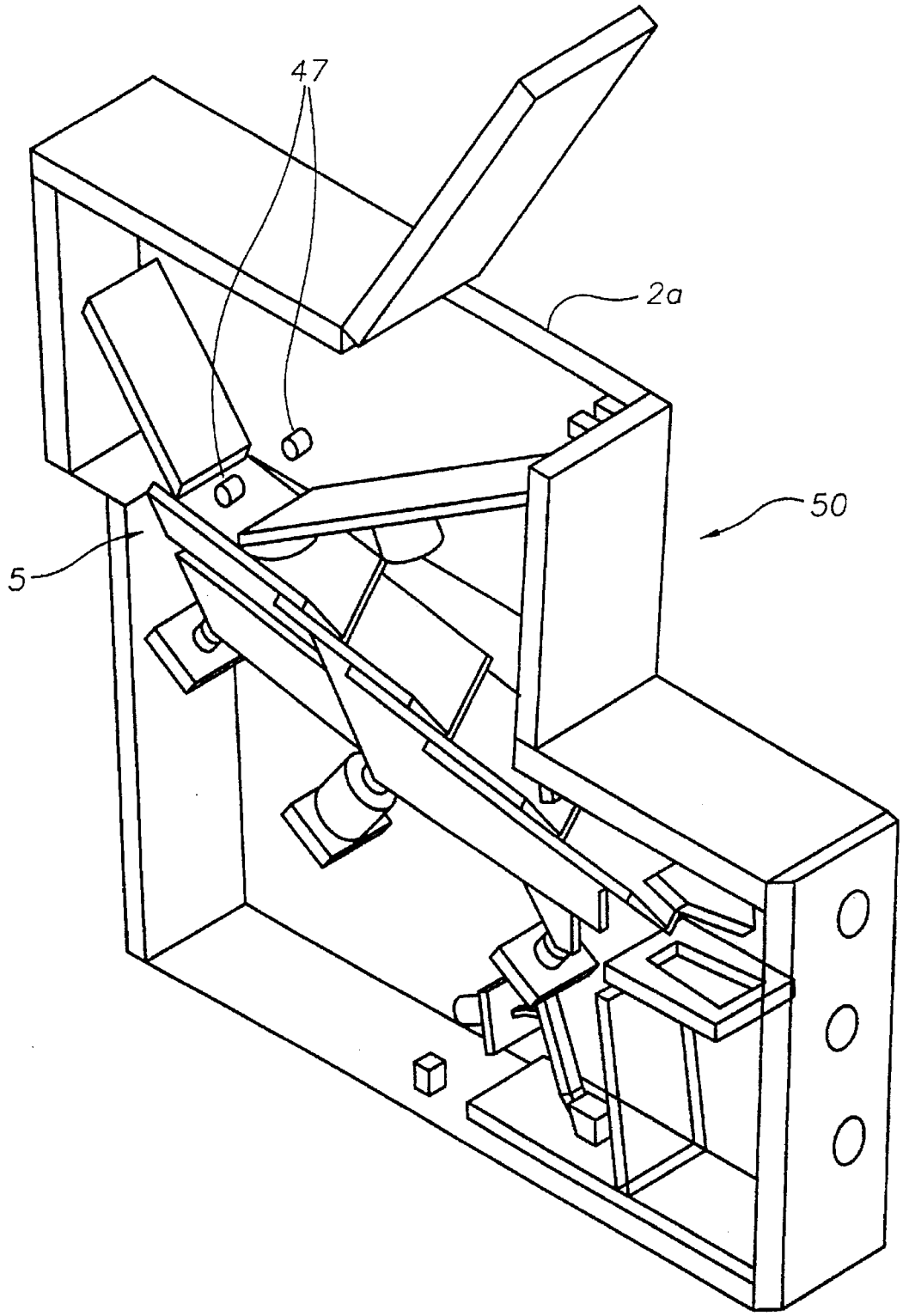
FIG. 5 illustrates a cut-away perspective view of the housing shown in FIG. 4, with the apparatus of FIG. 2 disposed therein.

Referring to FIG. 5, a cut-away view Of the device 50 is illustrated. A light source and photodetector 47 placed adjacent the opening 5 of hopper 2*a*, senses whether tablets 1*a* are present. When tablets 1*a* are not present, and hopper 2*a* is known to contain additional tablets 1*a*, action is initiated to break a jam of tablets 1*a*. If a jam does not exist, photosensor 47 senses when there is a low level of tablets 1*a* in the hopper 2*a*. The photodetector 47 informs microprocessor 24 that the hopper 2*a* requires replenishment of tablets 1*a*.

Figure 6:
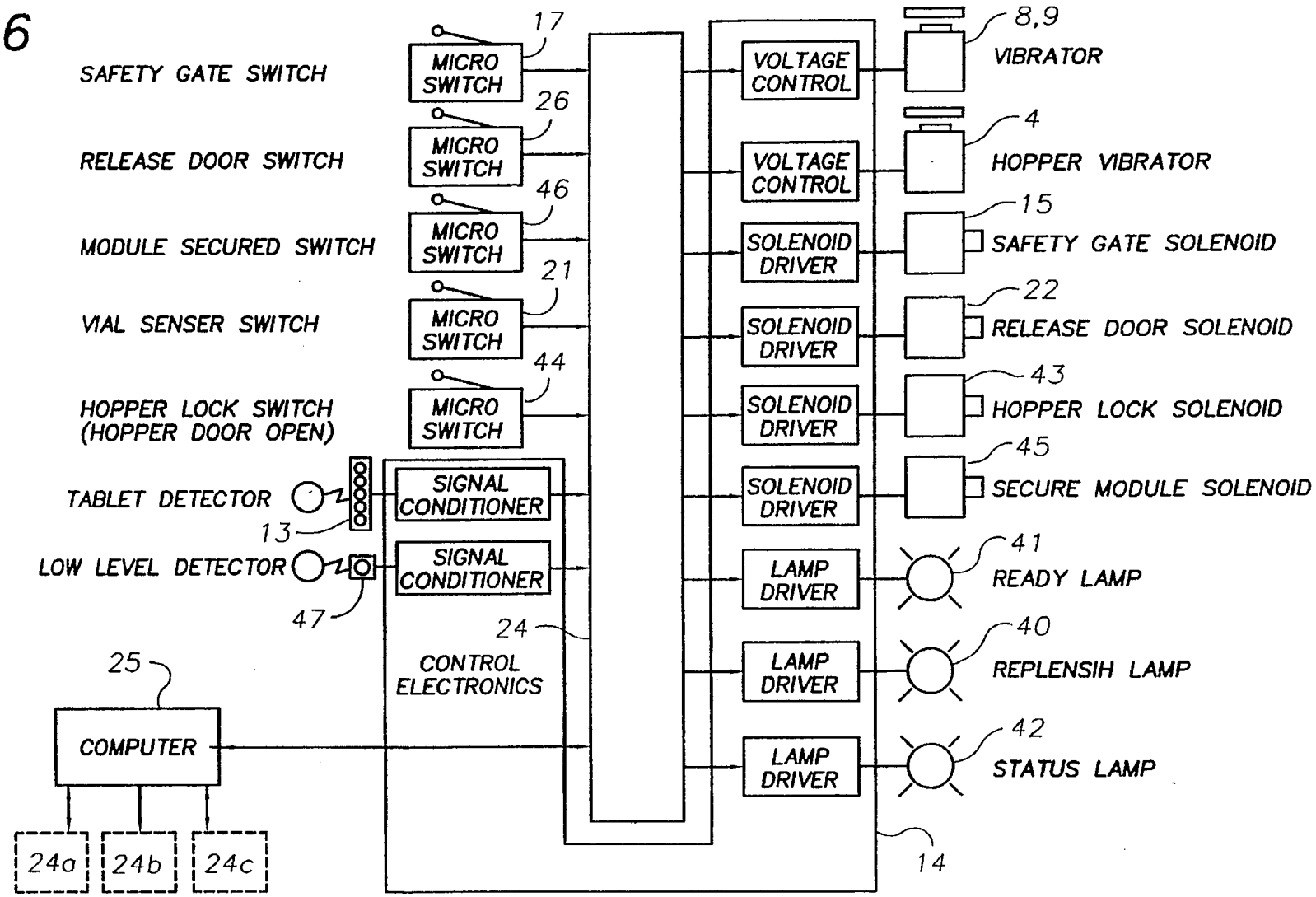
FIG. 6 is a block diagram of the microprocessor, control electronics, and indicator lamps of the invention.

Referring to FIG. 6, a block diagram of the computer 25, microprocessor 24, control electronics 14, and the several inputs and outputs which have been described above, with their interconnections, is depicted.

Figure 7:
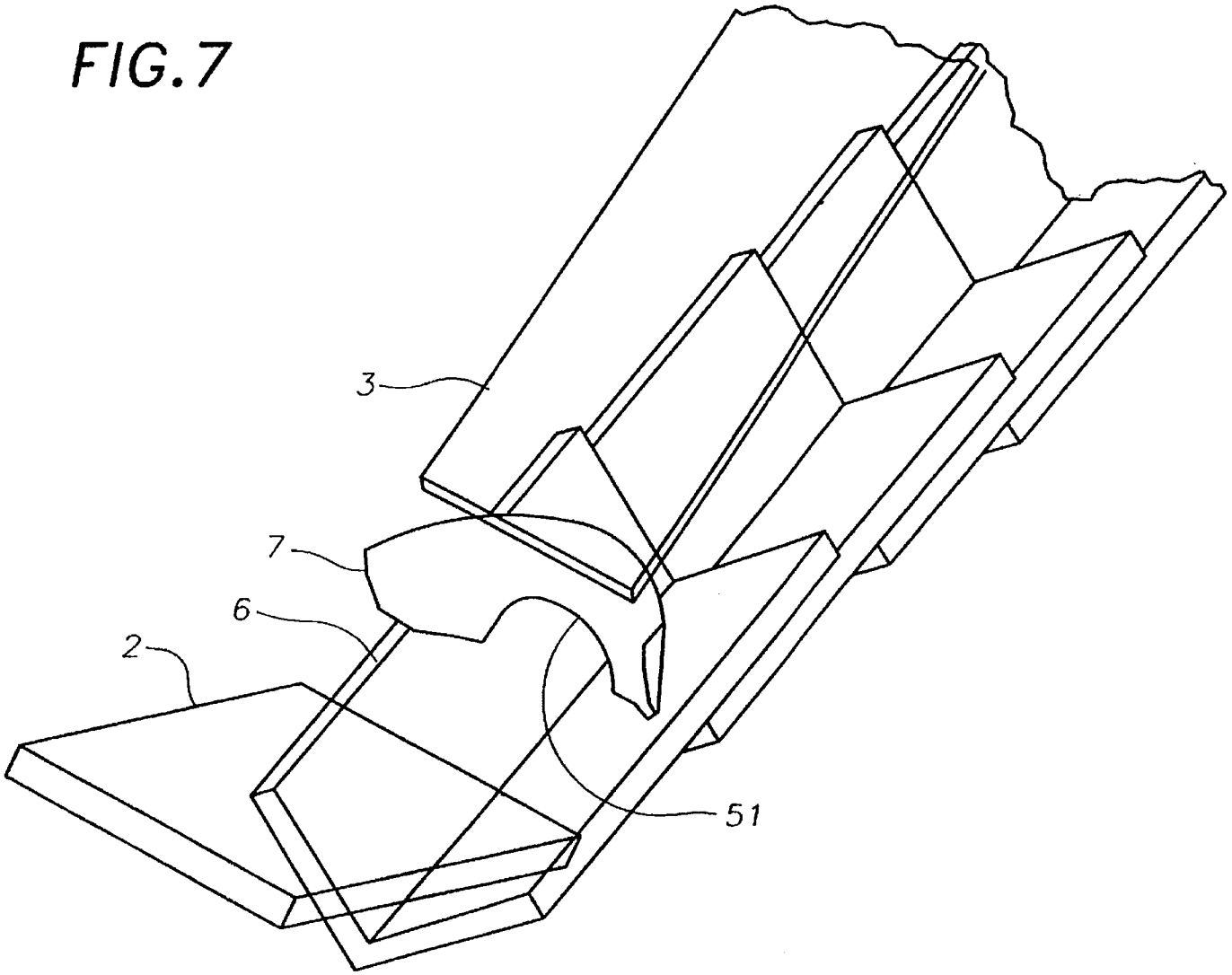
FIG. 7 illustrates a cut-away perspective view of the trough and metering device of the invention.

Referring now to FIG. 7, the metering device 7 is shown disposed proximate trough 6. An arcuate cutout 51 of the metering device 7 facilitates smooth flow of tablets, not shown, as they proceed down trough 6. The shape of the arcuate portion 51 coupled with the curvature and mounting angle of metering device 7 with respect to trough 6, allows the collection of tablets and capsules of various shapes to be limited in height as they proceed down trough 6.

Figure 8:
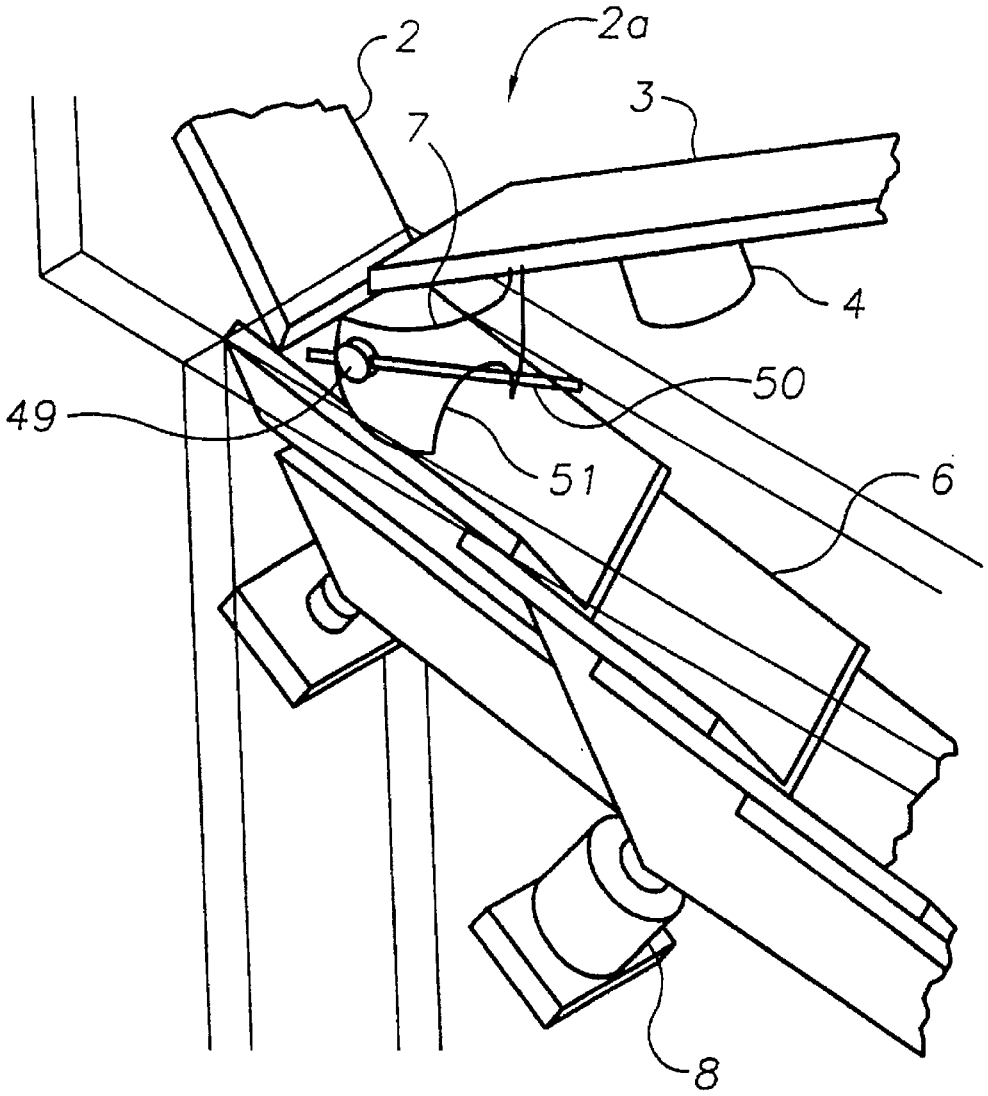
FIG. 8 illustrates a cut-away perspective view of the trough and metering device and adjustment mechanism therefor mounted on the housing.

Referring now to FIG. 8, there is shown a perspective view of metering device 7 mounted below plates 2 and 3 that form hopper 2*a*. An adjustment screw 49 is attached to metering device 7. A slot 56 provides a track along which metering device 7 can slide, parallel to sloping plate 3. Adjustment screw 49 is provided to slide metering device 7 along slot 56 to one of a predetermined number of detented positions. It has been found that three positions are sufficient to accommodate the various sizes of tablets, capsules, and pills, not shown.

Figure 9:
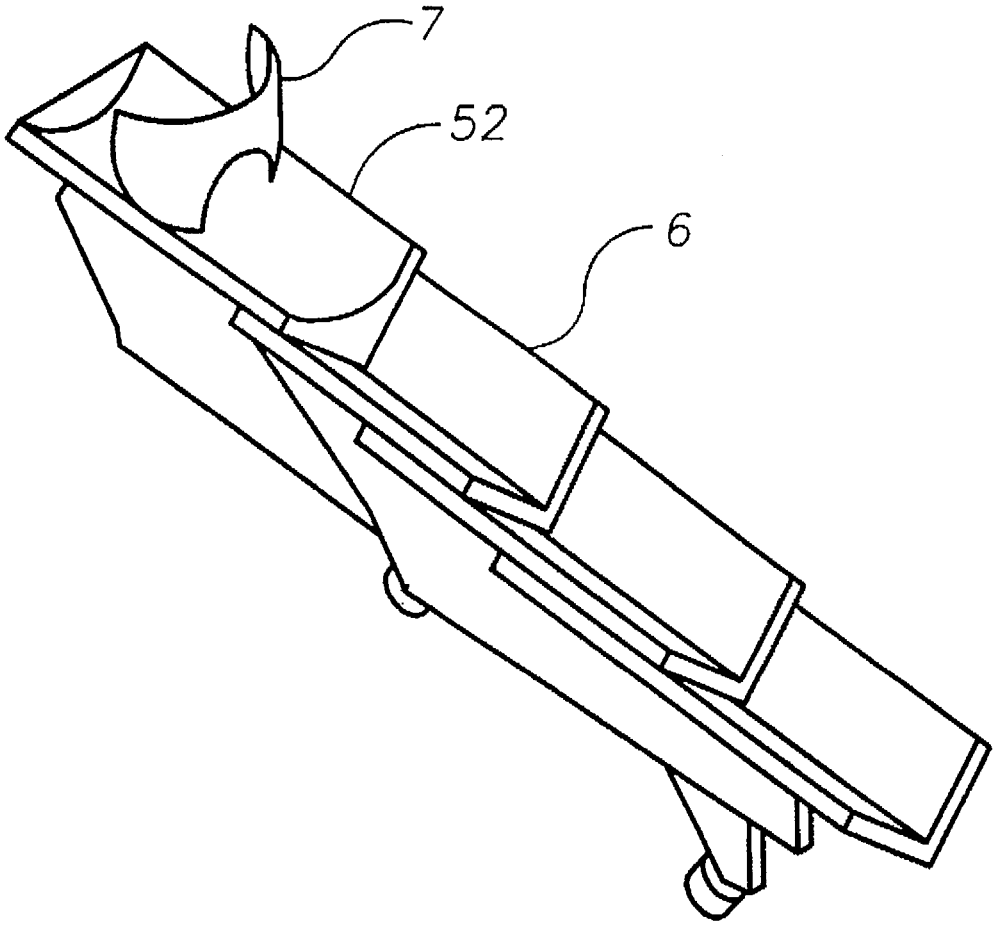
FIG. 9 illustrates a cut-away perspective view of a modified trough with metering device disposed thereon.

Referring now to FIG. 9, metering device 7 is shown disposed above the upper portion 52 of trough 6. In this alternate embodiment, upper portion 52 is curved, rather than V-shaped, as is shown in the remaining portions of trough 6. The curved upper portion 52 of trough 6 has been found to interface more naturally with metering device 7. Specifically, as trough 6 is vibrated, tablets, capsules and pills on curved upper portion 52 are agitated to a greater extent, allowing for a more uniform singulation and count rate of tablets along the trough 6.

Referring now to FIG. 3*a*, a high-level flow chart of system operations is shown at reference numeral 55. Information regarding tablet, capsule or pill size is first received, step 56, by main computer 25 (FIG. 1*a*). This information can be provided by a human operator or can be supplied upstream of the system by one or more automated prescription-filling computers, not shown.

The system determines whether the hopper 2*a* has sufficient tablets 1*a* for filling prescriptions, step 58. If the hopper must be replenished, step 58, human or automated replenishment occurs, step 60. Once the hopper has been replenished, step 60, the system is poised to receive a command to dispense a predetermined number of tablets, step 62. Once such a command is received, step 62, the safety gate is opened and the release door is closed, step 64. The hopper and V-plate vibrators are energized, step 66. The tablet detector is also activated, step 68. If no tablets are detected by tablet detector, step 70, the system pauses in its quiescent state. Once tablets begin to flow, however, they are counted, step 72. If the count of tablets has not reached the predetermined quantity specified in the command received in step 62, the system calculates the flow rate, step 76, and determines whether the flow rate is optimum, step 78. If it is not optimum, step 78, the V-plate vibration parameters are adjusted, step 80. If, however, the flow rate is optimum, step 78, system processing continues.

If the count of tablets has been reached, step 74, the safety gate is then closed, vibrators are de-energized, and after an appropriate command is received from main computer 25, a "ready" light is turned on, step 82. The system then determines whether a bottle or vial is present, step 84. If not, system operation halts until a bottle is present. At that time, the release door is opened and tablets are dispensed into the vial, step 86. The system performs a final check, step 88. If a malfunction occurred, step 88, the main computer 25 is informed of such malfunction, step 90. The system is instructed to proceed, step 92, only when the malfunction has been successfully addressed.

Referring to FIGS. 3*b* through 3*l*, a more detailed flow chart 100 is shown of the programming used to operate device 50. The main computer 25 directs that a drive voltage be sent to the electromagnet 8, step 101. The main computer 25 also sends a signal to supply a drive voltage for the hopper vibrator 4, step 102. The main computer 25 sends the control characteristic for a particular tablet type to the microprocessor 24 and control electronics 14, step 103. Anti-jam characteristics for the particular tablet type as applied to the trough 6, are supplied to the electronics 14 by the main computer 25, step 104. Anti-jam characteristics for the particular tablet type as applied to the hopper, are supplied to the electronics 14 by the main computer 25, step 105.

Step 106 illustrates the receipt of detection characteristics for the tablet, as sent by computer 25. The anticipated dispensing rate is received from the computer 25, step 107. The maximum number of the tablets that can be held in the buffer area is calculated by the computer 25, and this information is sent to the electronics 14, step 108. The computer 25 instructs the electronics with respect to voltage and duty cycle characteristics for the last few tablets traveling along trough 6, step 109. The computer 25 supplies the pattern needed to shake tablets loose from the buffer area via door 20, step 110. Receipt of all of the above information is then verified, step 111. The decision is made, step 112, whether the message has been received from computer 25, that the hopper requires replenishment. If the answer is no, step 113, the system low level indicator 27 requests that replenishment is required. If the answer is no, step 114, the system receives a command for an order of counted tablets from the main computer 25, including information as to tablet type and the tablet count. The system determines whether internal inventory count in the microprocessor 24 indicates that this order can be filled without hopper replenishment, step 115. If the answer is yes, step 116, the safety gate solenoid energizes.

The system then determines whether the switch 17 indicates that safety gate 16 is open, step 117. If so, step 118, the system then determines whether switch 26 indicates that release door 20 is closed. If the answer is yes, step 119, the hopper vibrator 4 is turned on, step 120, and the trough electromagnet 8 is turned on with the proper amplitude.

Next, the system determines whether a tablet has been detected by detector 13, step 121. If the answer is yes, step 122, the electronics adds one to the count of tablets in buffer area 30*a*. The electronics then subtracts one from the count of tablets in inventory (hopper 1*a*), step 123. The tablet counting rate is computed, step 124. The system then determines whether the counting rate is too high or too low, step 125. If so, step 126, the electronics executes a flow control algorithm. Then, the system inquires whether the tablet count in the buffer area is near the desired count, step 127. If not, then step 121 is performed again via line 128.

If the counting rate is neither too high nor too low, step 125, then the tablet count, step 127, is near the desired count. The electronics activates the vibration in the trough to slow the count or singulation mode, step 129. The system determines whether the desired tablet count has been reached, step 130. If not, then step 121 is performed again via line 128.

If the sensor 13 does not detect a tablet at the mouth of buffer area 30*a*, step 121, decision step 131 is performed. If the tablet timeout has been exceeded, then the step 121 is performed again via line 132. If the timeout has been exceeded, then decision step 133 is performed. If the anti-jam procedure time out has not been exceeded, a command is issued to activate the anti-jam procedure for hopper vibrator 4, step 134. The electronics also activates the anti-jam procedure for the electromagnet 8 of trough 6, step 135. After both anti-jam procedures have been executed, then decision step 121 is performed again via line 132.

If the desired count is reached, step 130, the electronics is instructed to turn off the electromagnet 8 that vibrates the trough 6, step 136. The electronics turns off the hopper vibrator 4, step 137. The safety gate solenoid is de-energized, step 138, thus closing the entrance to buffer area 30*a*.

The system determines whether the gate safety switch 17 indicates that the gate 16 is closed, step 139. If not, has a timeout been executed (step 144)? If not, then decision step 141 is performed again via line 145. If yes, the main computer 25 is informed, step 146, and the system awaits further instructions, step 147.

If the timeout has executed, step 141, then after an appropriate signal is received from main computer 25, the ready light 41 is energized, step 140. If the vial is detected under the release door 20, step 141, then the release door 20 is actuated, step 142. If the switch 26 for release door 20 indicates that the door is open, step 143, then the release door solenoid 22 is actuated repeatedly to clear the contents from buffer area 30*a*, step 148. The electronics 14 de-energizes the solenoid 22, step 149. The indicator ready light 41 is deactivated, step 150. The system determines whether the switch 26 indicates that the release door 20 is closed, step 151. If not, step 152, faulty operation is then reported to the main computer 25. The system then awaits further instructions, step 153. If the release door is closed, step 151, the main computer is notified that the transfer of the tablets has been completed to the vial, step 154, and the system determines whether a message has been received from the computer that the hopper needs replenishment, step 112. If the answer is yes, then step 155 is performed. This step 155 can also be performed from a yes decision from decision step 113, indicating hopper replenishment is required, and a no decision from decision step 115, indicating that the order cannot be filled without hopper replenishment.

A report of faulty operation, step 152, can also be obtained from a no decision as to whether the safety gate 16 is open, step 117, a no decision as to whether the switch 26 indicates the release door is closed, step 118, a yes decision as to whether an anti-jam procedure timeout has been exceeded, step 133, a no decision as to whether safety gate switch 17 indicates that the safety gate is closed, and a no decision, step 143, as to whether the safety door switch 26 indicates that the release door is open.

After energizing the replenish lamp 40, step 155, the system waits for a message from the computer 25 that the technician has placed the bar code label on the bottle that has been filled with tablets, step 156. The system determines whether these are the correct tablets, step 157. If the answer is no, a message is sent to computer 25, step 158, and the system awaits further instructions, step 159.

If yes, step 157, the system waits for a message from the computer 25 that the barcode has been wanded on a module, step 160. It is then determined whether the correct barcode has been placed thereon, step 161. If not, then steps 162 and 163 are performed, instructing the system to send a message to computer 25, and await further instructions.

If the correct barcode has been wanded, step 161, the system waits for a message from computer 25 that the technician has wanded a barcode label on his badge, step 164. The system determines from that barcode whether this person is authorized, step 165. If the answer is no, then steps 166 and 167 are performed, instructing the system to send a message to the computer 25, and await further instructions.

If the person is authorized, step 165, then the system waits for a message from the computer that the technician has entered the quantity and expiration date of the new tablets, step 168. The system determines whether this data is acceptable, step 169. If it is not acceptable, then steps 170 and 171 instruct the system to send a message to computer 25, and await further instructions. If the data is acceptable, then the system determines whether the secure switch 46 indicates that the module has been extended from the frame, step 172. If the answer is no, then the system determines whether the module extension timeout been exceeded, step 173. If yes, then steps 174 and 175 are performed, and the system is instructed to send a message to computer 25 and await further instructions. If the module extension time has not been exceeded, step 173, then step 172 is performed again via line 176.

If the switch 46 indicates that the module has been extended from the frame, step 172, then the solenoid 43 is energized, thus unlocking hopper door 39, step 177. The system then determines whether the hopper door is open, step 178. If not, then the system determines whether a first hopper door timeout has been exceeded, step 179. If yes, then steps 180 and 181 are performed, and a message is sent to the computer and the system awaits instructions. If first hopper door timeout has not been exceeded, step 179, then decision step 178 is performed again via line 182.

If the hopper door is indicated as open, step 178, the hopper lock solenoid 43 is de-energized, automatically locking hopper door 39, step 183. A second timeout for the hopper door is then interrogated, step 184. If not exceeded, step 184 is performed again via line 185. If yes, then the system determines whether the lock switch 44 is indicating that the hopper door 39 is closed, step 184.

If not, then the system sends a message to the computer and awaits instructions, steps 187 and 188. If the hopper door 39 is closed, the system determines whether detector 47 indicates that the hopper is filled above the low level point, step 189. If not, then steps 190 and 191 are performed, and the system sends a message to the computer and awaits further instructions. If yes, the system determines whether module secure switch 46 indicates that the module is back in the frame, step 192. If not, then the system determines whether the module return timeout been exceeded, step 193. If yes, then the system sends a message to the computer and awaits instructions, steps 194 and 195. If the timeout has not been exceeded, step 193, then step 192 is performed again via line 196.

If the switch 46 indicates that the module is back in the frame, step 197, the system waits for a computer message that a pharmacist has wanded the barcode on his badge. If the user is not an authorized pharmacist, step 198, then steps 199 and 200 instruct the system to send a message to computer 25 and await further instructions.

If the user is an authorized pharmacist, however, step 198, the system waits for a message from the computer that the pharmacist has wanded a module. The system then determines whether this is the correct module, step 202. If no, then steps 203 and 204 instruct the system to send a message to computer 25 and await instructions. If this is the correct module, however, step 202, then the system waits for a message from computer 25 that the pharmacist has wanded his signature barcode indicating approval, step 205. The replenish lamp 40 is de-energized, step 206. A message is then sent to computer 25 that the hopper has been replenished, step 207. System control reverts to step 112, and the hopper is replenished with the next pharmacy order. The programmed cycle is then repeated.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A processor-controlled tablet, capsule or pill counting and dispensing system that counts and dispenses a wide variety of tablets, capsules and pills of different sizes and shapes, the steps comprising:

means for loading a platform with tablets, capsules, or pills of different sizes and shapes;

a platform in operative relationship to said loading means for receiving tablets, capsules, or pills, said platform having an upper end for receiving said tablets, capsules or pills from said loading means, and a lower end for dispensing singulated tablets, capsules, or pills to a counting means;

first vibratory means connected to said platform for imparting vibratory pulses to said platform in order to cause singulation of said tablets, capsules, or pills along said platform, thereby separating them so that they can be counted one at a time;

means for respectively supporting said platform at said upper end and said lower end, said means having a spring constant at said upper end that is higher than the spring constant at said lower end, whereby said platform is caused to vibrate under the influence of said vibratory means, more strongly at said lower end; and counting means disposed adjacent said lower end of said platform for counting said tablets, capsules, or pills, as they drop from said platform one at a time.

2. The processor-controlled tablet, capsule or pill counting and dispensing system in accordance with claim 1, wherein said first vibratory means comprises a single electromagnet that is disposed in a mid-portion of said platform.

3. The processor-controlled tablet, capsule or pill counting and dispensing system in accordance with claim 1, wherein said platform comprises a sloped, concave-shaped trough.

4. The processor-controlled tablet, capsule or pill counting and dispensing system in accordance with claim 3, wherein said concave-shaped trough comprises a V-shaped cross section for at least a portion thereof.

5. The processor-controlled tablet, capsule or pill counting and dispensing system in accordance with claim 3, wherein said concave-shaped trough comprises a U-shaped cross section for at least a portion thereof.

6. The processor-controlled tablet, capsule or pill counting and dispensing system in accordance with claim 3, wherein said sloped, concave-shaped trough comprises steps.

7. The processor-controlled tablet, capsule or pill counting and dispensing system in accordance with claim 3, wherein said sloped, concave-shaped trough comprises a roughened upper service.

8. The processor-controlled tablet, capsule or pill counting and dispensing system in accordance with claim 2, wherein said electromagnet is controlled by an alternating current input, and further comprising control means connected to said electromagnet for varying the alternating current input, in order to change parameters of vibration corresponding to different tablets, capsules, or pills.

9. The processor-controlled tablet, capsule or pill counting and dispensing system in accordance with claim 1, further comprising second vibratory means for assisting flow of said tablets, capsules, or pills from said loading means to said platform.

10. The processor-controlled tablet, capsule or pill counting and dispensing system in accordance with claim 9, wherein said second vibratory means is controlled by said control means, which adjusts vibrations imparted to said loading means.

11. The processor-controlled tablet, capsule or pill counting and dispensing system in accordance with claim 1, wherein said loading means comprises a hopper for holding a plurality of tablets, capsules, or pills, said hopper being disposed proximate said platform and in operative relationship therewith.

12. A tablet, capsule or pill counting and dispensing system that counts and dispenses a wide variety of tablets, capsules and pills of different sizes and shapes, comprising:

means for loading a platform with tablets, capsules, or pills of different sizes and shapes;

a platform in operative relationship to said loading means for receiving tablets, capsules, or pills therefrom, said platform having an upper end and a lower end for dispensing singulated tablets, capsules or pills to a counting means, first vibratory means connected to said platform for imparting a variety of vibratory pulses to a mid-portion of said platform in order to cause singulation of said tablets, capsules, or pills along said platform, said variety of pulses corresponding to different sizes and shapes of said tablets, capsules, or pills, thereby separating them so that they can be counted one at a time;

means for respectively supporting said platform at said upper end and said lower end, whereby said platform is caused to vibrate under the influence of said vibratory means, more strongly at said lower end; and counting means disposed adjacent said lower end of said platform for counting said tablets, capsules, or pills, as they drop from said platform one at a time.

13. The tablet, capsule, or pill counting and dispensing system in accordance with claim 12, wherein said first vibratory means comprises a single electromagnet that is disposed in a mid-portion of said platform.

14. The tablet, capsule, or pill counting and dispensing system in accordance with claim 12, wherein said platform comprises a sloped, concave-shaped trough.

15. The tablet, capsule, or pill counting and dispensing system in accordance with claim 14, wherein said sloped, concave-shaped trough comprises steps.

16. The tablet, capsule, or pill counting and dispensing system in accordance with claim 13, further comprising processing means, and wherein said electromagnet is controlled by an alternating current input under the influence of said processing means operatively connected to said electromagnet for varying the alternating current input, in order to change parameters of vibration corresponding to different tablets, capsules, or pills.

17. The tablet, capsule, or pill counting and dispensing system in accordance with claim 13, further comprising second vibratory means connected to said loading means for assisting flow of said tablets, capsules, or pills from said loading means to said platform.

18. The tablet, capsule, or pill counting and dispensing system in accordance with claim 17, wherein said means for respectively supporting said platform has a spring constant at said upper end that is greater than the spring constant at said lower end.

19. The tablet, capsule, or pill counting and dispensing system in accordance with claim 12, further comprising:

metering means disposed along said platform for dispensing tablets, capsules, or pills thereunto at a predetermined level, so that the rate of dispensing and singulation of said tablets, capsules, or pills is assured.

20. The tablet, capsule or pill counting and dispensing system in accordance with claim 19, further comprising:

means operatively connected to said metering means to facilitate the adjustment thereof in order to accommodate physical parameters of said tablets, capsules, or pills.

* * * * *